US008393827B1

(12) United States Patent
Happel

(10) Patent No.: US 8,393,827 B1
(45) **Date of Patent: *Mar. 12, 2013**

(54) BOX SERVICE PANEL DOOR AND EQUALIZER

(76) Inventor: Tom Happel, Cocoa, FL (US)

( * ) Notice: Subject to any disclaimer, the term of this patent is extended or adjusted under 35 U.S.C. 154(b) by 593 days.

This patent is subject to a terminal disclaimer.

(21) Appl. No.: 12/533,806

(22) Filed: Jul. 31, 2009

(51) Int. Cl.
*E02B 7/28* (2006.01)

(52) U.S. Cl. ..... 405/104; 405/90; 405/103; 405/105; 251/326

(58) Field of Classification Search ..... 405/36, 405/80, 87, 90, 103, 104, 105, 106; 251/326, 251/204; 49/209, 216, 218, 219; 210/162, 210/170.03; 137/630, 630.12
See application file for complete search history.

(56) References Cited

U.S. PATENT DOCUMENTS

| | | | | |
|---|---|---|---|---|
| 920,961 | A * | 5/1909 | Keil | 292/52 |
| 2,436,793 | A * | 3/1948 | Danel | 405/76 |
| 2,485,755 | A * | 10/1949 | Loosli | 405/90 |
| 2,652,946 | A * | 9/1953 | Beatty | 220/262 |
| 3,237,915 | A * | 3/1966 | Palmer et al. | 251/158 |
| 4,070,863 | A * | 1/1978 | Brown | 405/105 |
| 4,509,717 | A * | 4/1985 | Wright et al. | 251/144 |
| 4,785,966 | A * | 11/1988 | Waltke | 220/345.6 |
| 5,518,024 | A * | 5/1996 | Weeks et al. | 137/420 |
| 6,032,421 | A * | 3/2000 | Yamada | 52/79.8 |
| 6,270,663 | B1 | 8/2001 | Happel | |
| 6,428,692 | B2 | 8/2002 | Happel | |
| 6,797,162 | B2 | 9/2004 | Happel | |
| 6,869,525 | B1 | 3/2005 | Happel | |
| 6,979,148 | B2 | 12/2005 | Happel et al. | |
| 7,153,417 | B2 | 12/2006 | Happel | |
| 7,270,747 | B2 | 9/2007 | Happel | |
| 7,294,256 | B2 | 11/2007 | Happel et al. | |

OTHER PUBLICATIONS

Rising and Non-Rising Stem, Telescoping Valves, [online] Halliday Products, [retrieved on Jun. 15, 2009] 4 pages, Retrieved from www.hallidayproducts.com/ssg.html.
Aluminum Slide and Weir Glass, [online] Water and Waste Water Valves and Gates, [retrieved on Jun. 15, 2009] 10 pages, Retrieved from http://ncvg.net/products/alimSlideWeir.html.

* cited by examiner

*Primary Examiner* — Sean Andrish
(74) *Attorney, Agent, or Firm* — Brian S. Steinberger; Law Offices of Brian S. Steinberger, P.A.

(57) ABSTRACT

Systems, devices, apparatus, and methods of locking and unlocking a door that is slidable through tracks, over an entry port to a storm water type vault or storm water structure. Locking the door in place can be accomplished by rotating upwardly protruding bolt type heads that are fixably attached to cams. Rotating the bolt type heads causes the cams to press the door against one side of the tracks. An elongated sealing strip can be compressed between the door edges and the one side of the track and seal and prevent water from passing about the sides of the door. Alternatively, removable wedges can be used to compress door edges in place. Furthermore, a hinged pressure relief door can be attached over a small opening in the slidable door. Opening the small pressure relief door by an elongated tool allows for water on both sides of the sliding door to equalize. Once water has equalized on both sides the tool can be used to rotate the bolt type heads on the top of the slidable door and make it easier to next pull the sliding door from the tracks. The vault/structure can be sealed so that a vacuum truck can then remove water and debris contents inside of the vault/structure at the beginning of the treatment service.

15 Claims, 23 Drawing Sheets

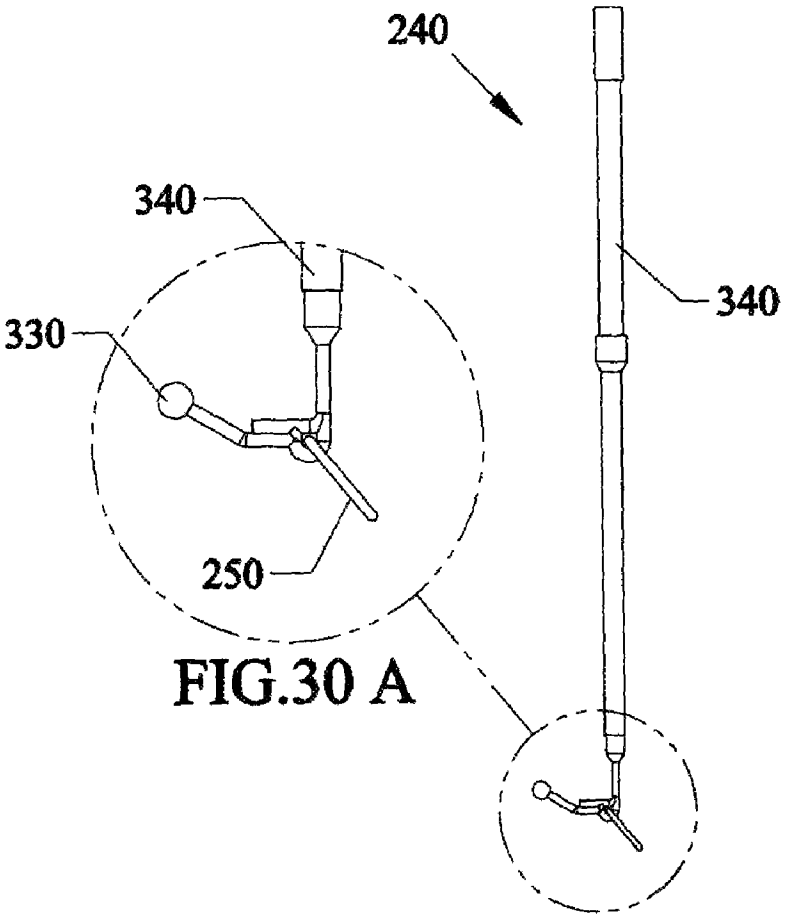
FIG.30
FIG.30 A
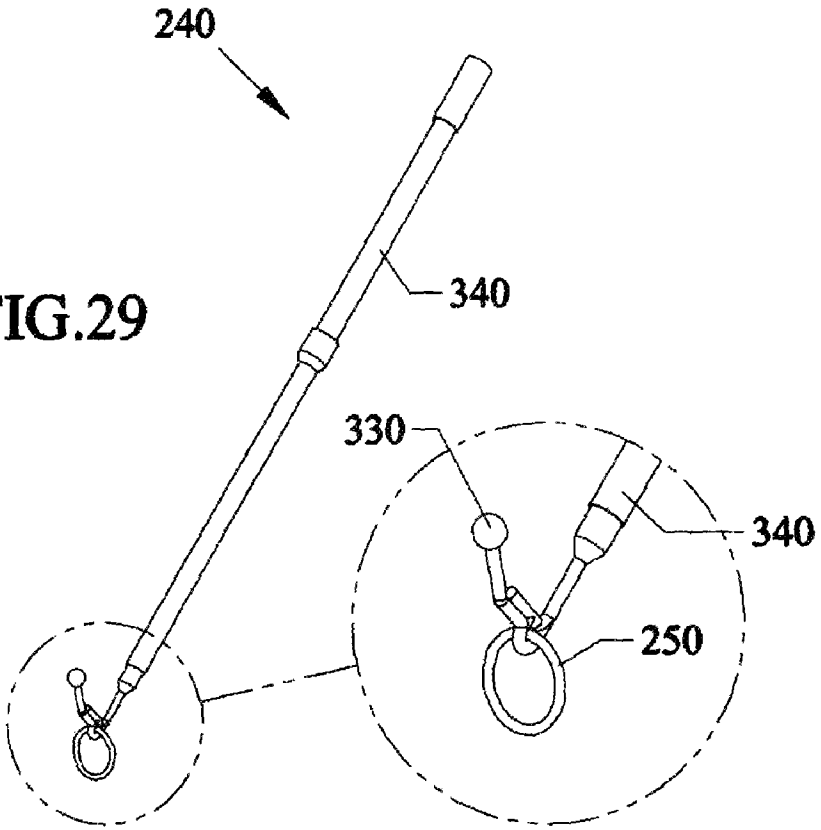
FIG.29
FIG.29 A

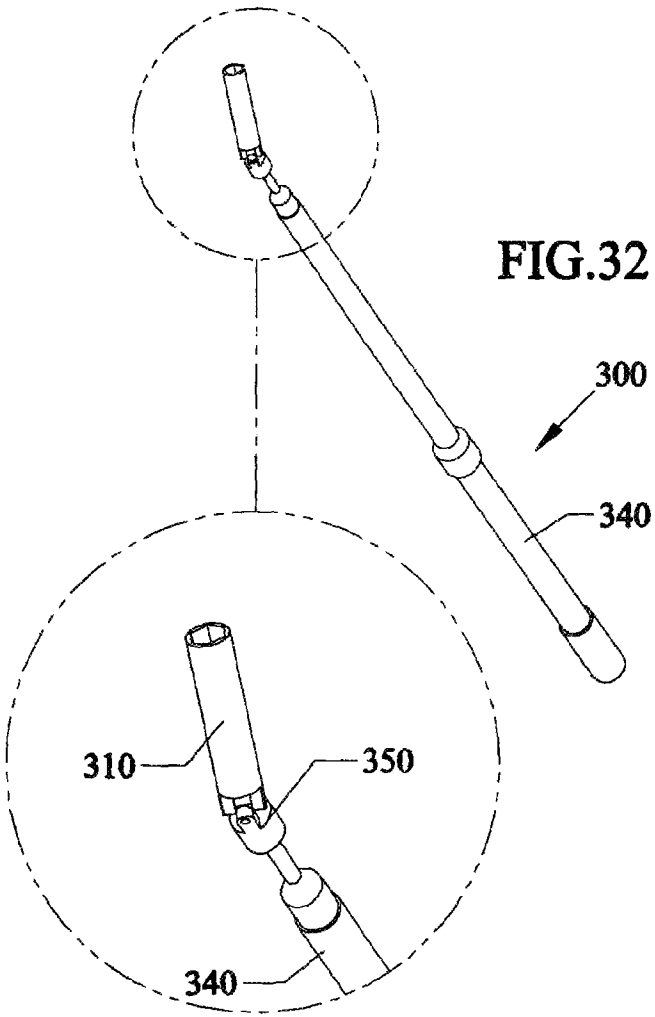
FIG.32
FIG.32 A
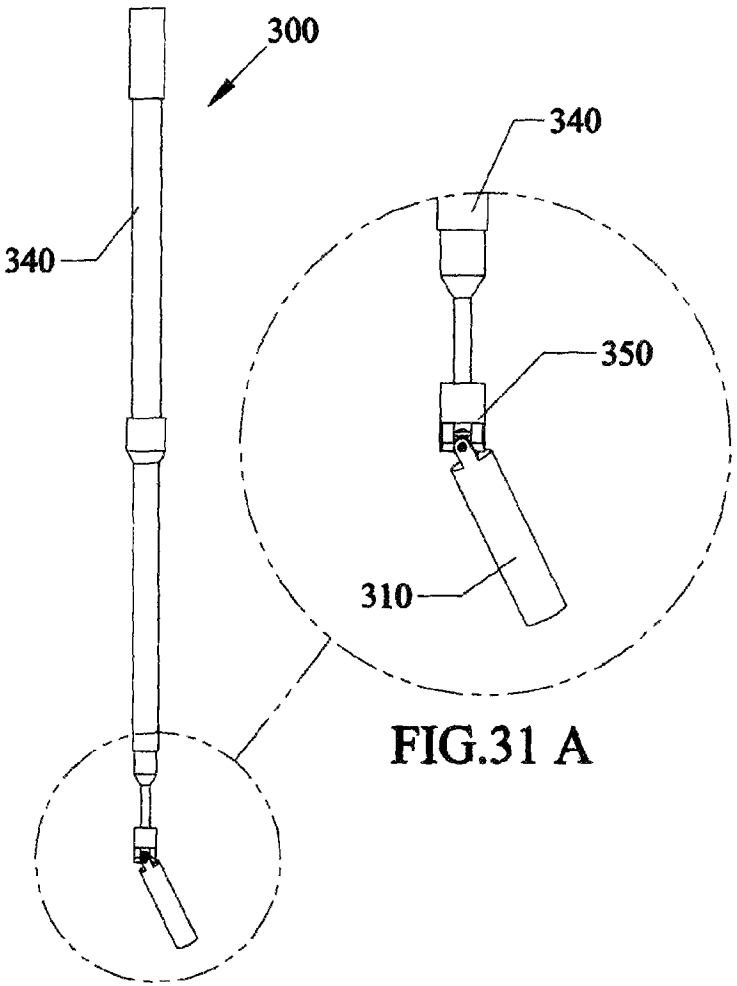
FIG.31 A
FIG.31

BOX SERVICE PANEL DOOR AND EQUALIZER

This invention relates to stormwater treatment, in particular to devices, apparatus, systems and methods of using a damper system to isolate a stormwater treatment structure from unwanted water inflow during servicing so that a vacuum such as vacuum truck deals with the contents of the treatment structure at the beginning of the service, where a slidable door can be sealed in place with rotatable cams pushing one side of the door against portions of the tracks, and a small pressure relief door can be used in the sliding door to allow for water pressure to equalize on both sides of the sliding door, or alternatively using removable triangular wedges to jam the door in place.

BACKGROUND AND PRIOR ART

There are federal clean water requirements that require water bodies such as lakes and rivers must meet strict minimal water quality specifications. To achieve these requirements, stormwater drainage pipes often require treatment before conveying stormwater into receiving water bodies. As a result, a wide variety of technologies have been developed to treat stormwater and improve the water quality. A common variety of stormwater treatment systems are hydrodynamic separators such as baffle type boxes and vortex systems. However, over time stormwater treatment systems often will fill with collected debris and will require service to remove the collected debris.

The servicing of a stormwater treatment structure typically requires the use of a vacuum truck that will suck out the collected solids and water within the structure. After the vacuum truck removes the debris and water from the stormwater structure, the vacuum truck transfers those contents to a processing facility for proper disposal. However, servicing stormwater structures is often complicated by unwanted water flow running into the stormwater structures during the service procedure. This unwanted water flow typically originates from high water levels in lakes and rivers adjacent to the treatment structure, or from an upstream base flow.

While the vacuum truck is removing water and debris from the treatment structure, water sometimes continues to flow in. Often the amount of water flowing into the treatment structure during servicing exceeds the rate at which the vacuum truck can remove the water. Having water enter the stormwater structure during servicing procedure reduces the effectiveness and efficiency of the service procedure and results with having the vacuum truck to dispose of additional water.

There have been attempts over the years to try to use a damper or gate type system, such as the aluminum slide and weir gates manufactured by Northcoast Valve & Gate Inc., and slide gates manufactured by Halliday Products Inc. The common problem with damper or gate systems used in the prior art is that they are either difficult to install and use, or they leak badly.

Thus, the need exists for solutions to the above problems with the prior art.

SUMMARY OF THE INVENTION

A primary objective of the present invention is to provide devices, apparatus, systems and methods of using a damper system to isolate stormwater treatment structures from unwanted water inflow during servicing so that only a vacuum such as vacuum truck deals with the contents of the treatment structure at the beginning of the service.

A secondary objective of the present invention is to provide devices, apparatus, systems and methods of using a damper system in a stormwater treatment structure that will reduce service treatment time and increase the effectiveness of the service which will improve the removal efficiency of the treatment structure and reduce servicing costs.

A third objective of the present invention is to provide devices, apparatus, systems and methods of using a damper system in a stormwater treatment structure that is easy to install and use, and will not leak.

The novel damper system can include a track that attaches to the inside wall of a stormwater vault or treatment structure, and a damper panel that slides into the track.

The external housing of the stormwater vault or treatment structure is commonly made of concrete, fiberglass, or plastic. The damper system track can be installed so that it makes a kind of frame around the inflow and/or outflow pipes and is attached to the inside surface of the treatment structure. A track system can be ideally sized to accommodate the damper panel.

The damper panel is typically made of metal, fiberglass, or plastic, combinations thereof, and the like, can have a cam system mechanism along the vertical edges of the panel on one side. On the other side of the panel a rubber seal is continuous along the edge of the panel, going down one side, then across the bottom, and then up the other side. When the damper panel is lowered into the track system to block the pipe it is very loose and does not bind along the track system. When the cams are rotated the mechanism can then force the panel to wedge into the track and compress the rubber seal along the inside surface of the track. Once the cams have wedged the damper panel in place and the rubber seal is compressed against the track, the panel is locked in place and it will not leak water from the pipe into the stommwater vault.

The cams can be rotated to either lock the damper panel in place or release the damper panel. The cams can be either rotated by a lever attached to the top of the cam system, or a wrench, or other tools such as but not limited to pliers, pipes, and the like. The wrench can be either hand held or socket attached to the end of a hand held pole. The advantage of attaching the socket to the end of a long pole is that a person does not need to enter the vault to rotate the cams.

The damper panel can have a special lifting point attachment that allows the panel to be lowered into the track system without having to enter the vault. The lifting point would have a slot that would sized to receive an approximately 1" diameter ball such as a metal sphere attached to the end of a thin rod, and the rod would be attached to a hand held pole. The damper panel would hang vertically on the end of the hand held pole and the geometry of the sphere in the slot would allow the damper panel to freely articulate on the end of the pole without binding. By this method the damper panel can be easily lowered into the vault and placed into the damper track. Once the damper panel is in place in the track, the sphere on the end of the pole can be slid out the bottom of slot in the lifting point attachment and the pole removed from the vault.

A pressure equalization door with a quick release latch can be built into the lower portion of the damper panel. When the water has been removed from the inside of the vault, water pressure from the pipe side of the damper panel will prevent the damper panel from being easily removed after servicing. To equalize the pressure on both sides of the damper panel, a small quick release door positioned near the bottom of the damper panel can be opened allowing water to pour through. A rubber seal around the edge of the equalization door can seal and prevent water from prematurely leaking around the door. A quick release latch can be used to hold the door closed. To open the door the latch can be reached either by hand or by a tool attached to the end of a hand held pole. Once the latch is opened the water pressure on the pipe side of the damper panel will push the equalization door open allowing water to flow into the vault. When the water level on each side of the damper panel is equal in elevation the damper panel can be easily removed.

The separate rotatable cams in each of the tracks can be replaced by single elongated cams that can have paddle or wedge shapes. Alternatively, the invention can use removable wedges that when driven into place compress and water seal the damper panel in place.

Further objects and advantages of this invention will be apparent from the following detailed description of the presently preferred embodiments which are illustrated schematically in the accompanying drawings.

BRIEF DESCRIPTION OF THE FIGURES

FIG. 29 is a perspective view of the Hook/Ring tool.

FIG. 29A is an enlarged view of the hook and ring portion of the tool of FIG. 29.

FIG. 30 is a side view of the Hook/Ring tool.

FIG. 30A is an enlarged view of the hook and ring portion of the tool of FIG. 30.

FIG. 31 is a side view of the remote socket wrench tool.

FIG. 31A is an enlarged view of the socket wrench portion of the tool of FIG. 31.

FIG. 32 is a perspective view of the remote socket wrench tool of FIG. 31.

FIG. 32A is an enlarged view of the socket wrench portion of FIG. 32.

DESCRIPTION OF THE PREFERRED EMBODIMENTS

Before explaining the disclosed embodiments of the present invention in detail it is to be understood that the invention is not limited in its applications to the details of the particular arrangements shown since the invention is capable of other embodiments. Also, the terminology used herein is for the purpose of description and not of limitation.

A list of components will now be described.

Figure 1:
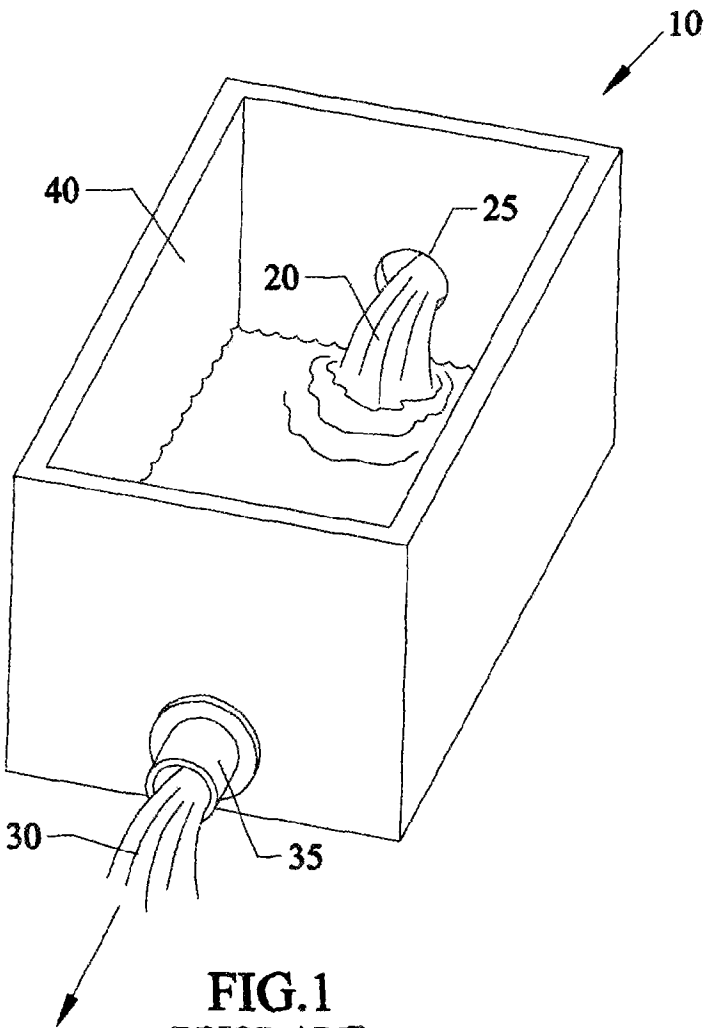
FIG.1 (PRIOR ART)
FIG. 1 is a top perspective view of prior art type concrete storm water handling vault.

10. Concrete storm water handling vault.
20. Storm water inflow.
25. Inlet port
30. Storm water outflow.
35. Outlet pipe
40. Vault wall.
50. Damper system.
60. Damper panel assembly.
70. Damper frame assembly.
71. Through-holes for fasteners
72. U-shaped plates
75. Parallel tracks in frame assembly
76. angled support plates
77. Lower channel for damper panel
78. Inner lip of frame
79. Another lip of frame
80. Panel lifting cleat.
90. Pressure relief door.
95. opening in panel
100. Pressure relief door release latch.
105. Base of latch attached to panel
110. Damper panel.
120. Damper panel lock release hex.
130. Lock release bar mount.
140. Damper panel guide bushing.
150. Damper panel stiffener brace.
160. Optional wrench to release panel lock.
170. Foam sealing strip.
180. Damper frame mounting hole.
190. Lock release bar.
210. Pressure relief door hinge.
230. Optional socket wrench to release panel lock.
240. Hook/Ring tool for remote unlatching of pressure relief door and lifting damper panel assembly from frame.
250. Ring on item 240 for lifting latch knob to free pressure relief door.
260. Latch knob.
270. Storm water in vault.
280. Storm water flows through open relief door to equalize pressure on both sides of damper panel so panel can be unlocked and lifted from frame.
290. Foam sealing strip around relief door.
300. Socket wrench tool for remote unlocking of panel assembly.
310. Socket for engaging damper panel lock release hex.
330. Steel ball to engage panel-lifting cleat.
332. Angled hook
340. Telescoping tube handle for remote hook/ring tool & socket wrench tool.
350. Universal joint for all angle operation of remote socket wrench tool.
360. Damper panel cam-lock.
400. Single elongated cam with rotatable ends
410. pivot axis
420. paddle shape
430. rounded tip end
440. wedge shape
450. half curved tip end
500. Removable wedge(s)
510. pre-attached triangular wedge attached to back of damper panel
520. removable triangular wedge
522. actuator end
525. release opening
528. narrow lower tip end FIG. 1 is a top perspective view of prior art type concrete storm water handling vault 10 that can have four vault walls 40 with storm water inflow coming in through an inlet port 25 into the vault 10 and eventually flow out 30 through an outlet pipe 35. The external housing of the stormwater vault 10 or treatment structure is commonly made of concrete, fiberglass, or plastic.

Figure 2:
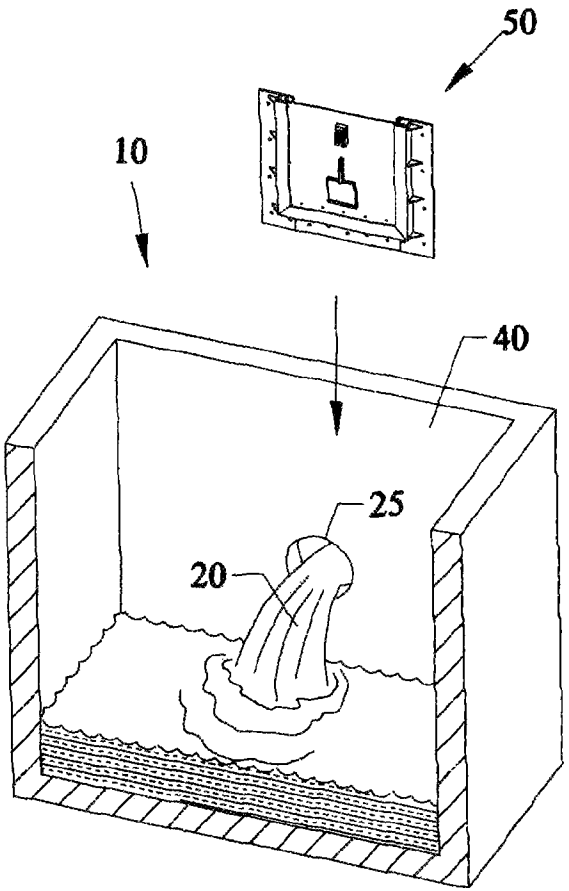
FIG. 2 is a cut-away perspective section view of the FIG. 1 vault with novel damper system invention ready to be installed.

FIG. 2 is a cut-away perspective section view of the FIG. 1 vault 10 with novel damper system 50 invention ready to be installed to an inner wall over the inlet port 25 to the vault 10.

Figure 4:
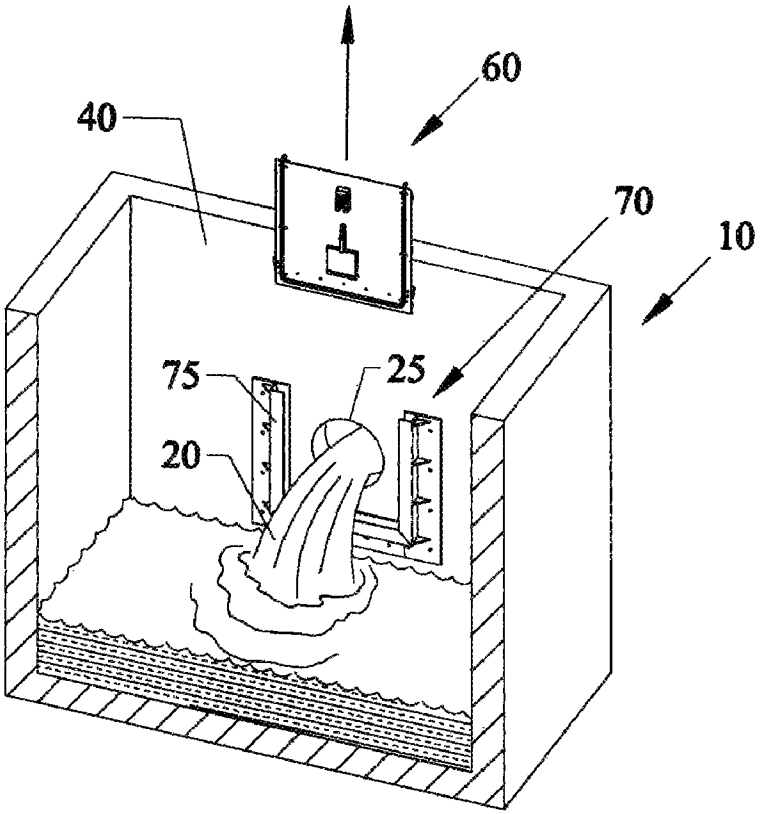
FIG. 4 is another view of FIG. 3 with the damper panel assembly removed from damper frame allowing water to flow into the vault.
Figure 3:
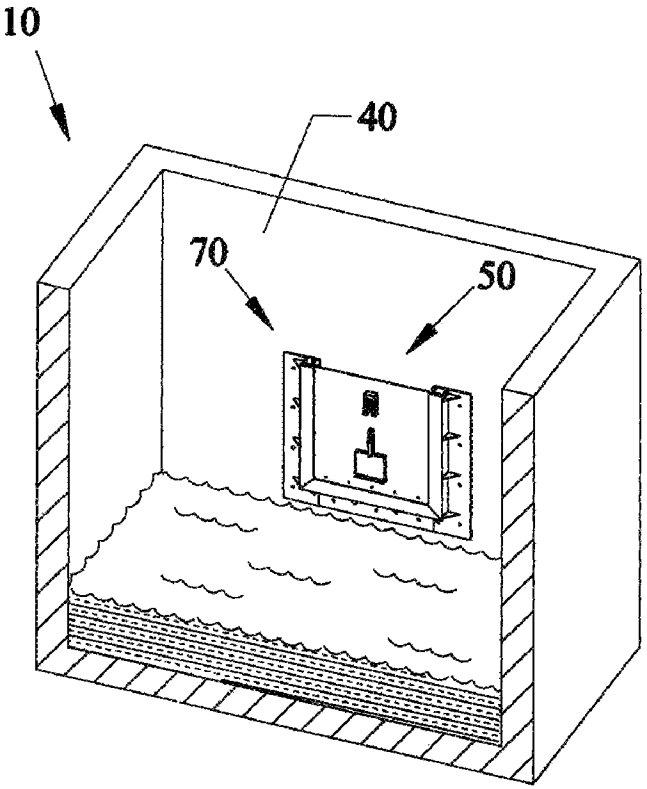
FIG. 3 is another view of the vault of FIG. 2 with the damper system installed for shutting off water flow into the vault.

FIG. 3 is another view of the vault 10 of FIG. 2 with the damper system 50 installed for shutting off water flow from the inlet port 25 into the vault 10. FIG. 4 is another view of FIG. 3 with the damper panel assembly 60 removed from damper frame assembly 70 allowing water 20 to flow into the vault 10 from inlet port 25.

The novel damper system 50 can include a damper frame assembly 70 that can attach to the inner surface of the wall 40 about the inlet port 25 by fasteners, such as but not limited to bolts, screws, and the like. Once installed, a damper panel assembly 60 can slide into parallel tracks in the damper frame assembly 70 to close off the inlet port 25.

Figures 5, 6:
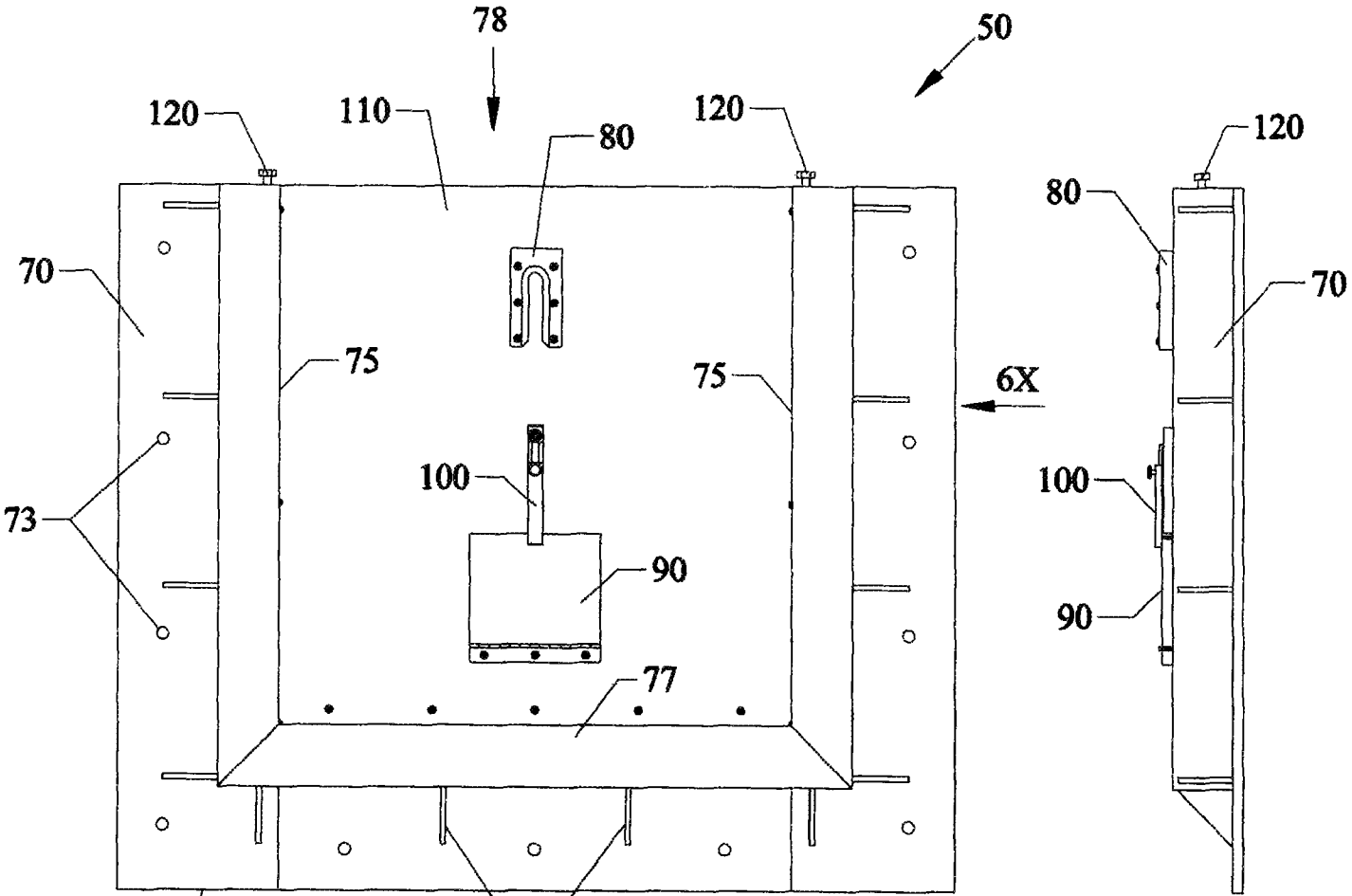
FIG. 5 is a front view of the damper system of FIGS. 2-4 with damper panel and frame.
FIG. 6 is a side view of the damper system of FIG. 5 along arrow 6X.

FIG. 5 is a front view of the damper system 50 of FIGS. 2-4 with damper panel 110 and frame assembly 70. FIG. 6 is a side view of the damper system 50 of FIG. 5 along arrow 6X. The damper panel 110 can be made from metal such as but not limited to aluminum, galvanized metal, stainless steel, fiberglass, plastic or combinations thereof.

Referring to FIGS. 5-6, through-holes 73 through the U-shaped side plates 72 of the frame assembly allow for the fasteners to be used to attach the frame assembly 70 to the inner wall 40 of the vault 10. Angled strengthening members 76 support the U-shaped plates 72 to the tracks 75. The damper panel 110 can slide along the parallel tracks 75 and sit against a lower channel 77. Across the inside face of damper panel 110 is a panel lifting cleat 80, pressure relief door 90 and pressure relief door release latch 100 which will be described in greater detail in reference to FIGS. 22, 22A, 23 and 23A.

Figure 7:
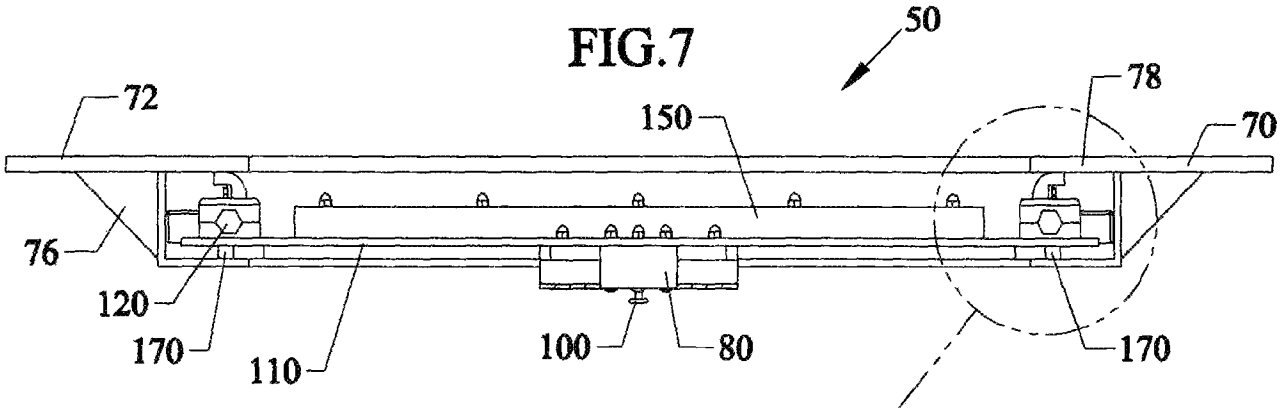
FIG. 7 is a top view of the damper system of FIG. 5 along arrow 7Y with damper panel assembly locked into the damper frame.
Figure 7A:
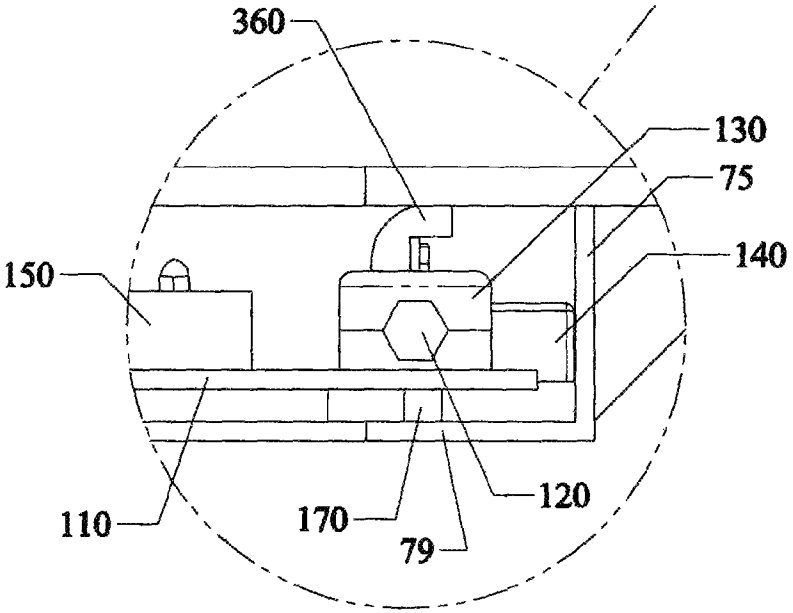
FIG. 7A is an enlarged view of the cam-lock mechanism of FIG. 7 in locked configuration.

FIG. 7 is a top view of the damper system 50 of FIG. 5 along arrow 7Y with damper panel 110 locked into the damper frame 72. FIG. 7A is an enlarged view of the cam-lock mechanism 360 of FIG. 7 in locked configuration abutting against an inner lip 78 of the frame 72. A damper panel stiffener brace(s) 150 can be attached across the bottom and/or the top of the damper panel 110 by fasteners, such as bolts and screws to increase the strength and stiffen the panel 110.

Figure 8:
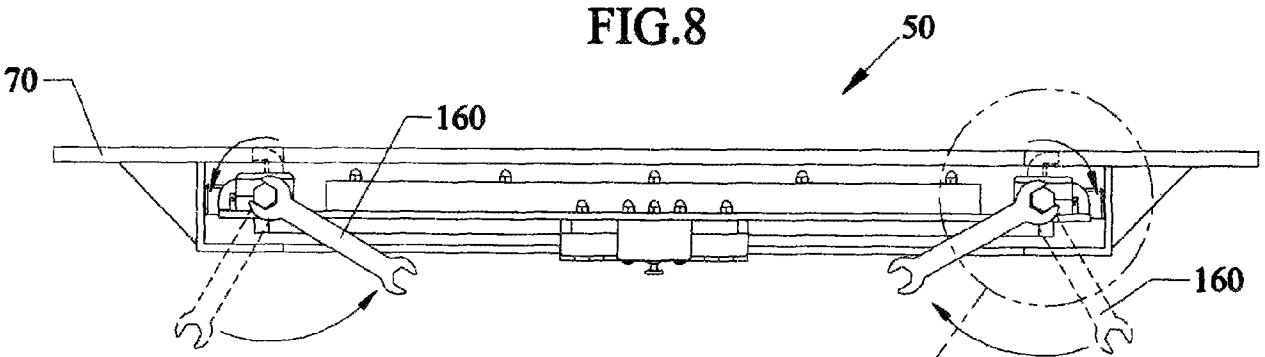
FIG. 8 is a top view of damper system of FIG. 7 with damper panel assembly unlocked from the damper frame. Detail of cam-lock mechanism in unlocked configuration.
Figure 8A:
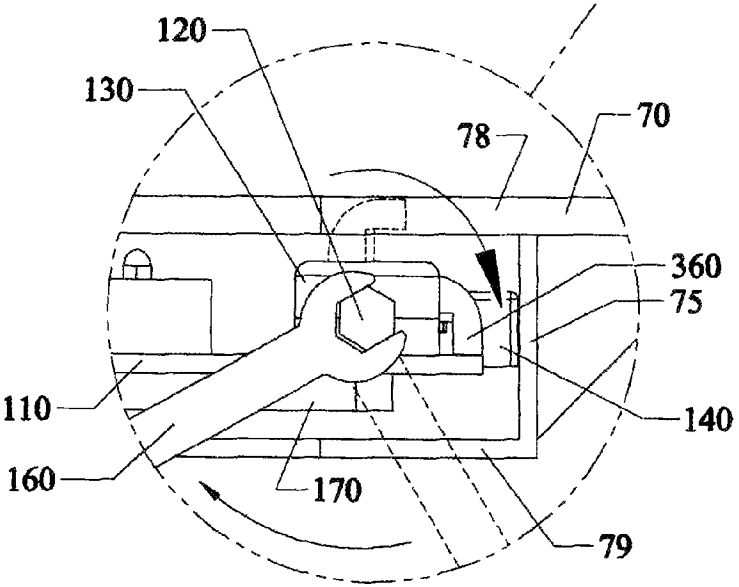
FIG. 8A is an enlarged view of the cam-lock mechanism in an unlocked configuration.

FIG. 8 is a top view of damper system of FIG. 7 with damper panel assembly unlocked from the damper frame 72. FIG. 8A is an enlarged view of the cam-lock mechanism in an unlocked configuration.

Referring to FIGS. 7, 7A, 8 and 8A, an installer can use a wrench 160 to lock and unlock the cam lock mechanism 360 by attaching the wrench 160 to a damper panel lock release hex 120. The latter of which is attached to a lock release bar mount 130 and cam lock mechanism 360. Rotating the wrench 160 (FIG. 8A) clockwise rotates the damper panel cam-lock clockwise from a locked position to an unlocked configuration. When the wrench 160 and hex nut 120 is rotated counter-clockwise, the damper panel cam-lock 360 rotates counter-clockwise from the unlocked configuration to a locked configuration. As the cam-lock 360 is moving to the locked configuration, the panel 110 is moved and shifted outward against a foam sealing strip 170 that can be located between perimeter edges of the panel 110 and another lip 79 of the frame 72. As the sealing strip 170 is being compressed a waterproof seal forms between the panel 110 and frame assembly 70.

Also shown in FIGS. 7A and 8A, is a damper panel guide bushing 140 that fits between the lock release bar mount 130 and the inside of the frame 72. The guide bushing 140 is useful to allow the panel 110 to slide down within the tracks 75 of the frame 72.

Figure 9:
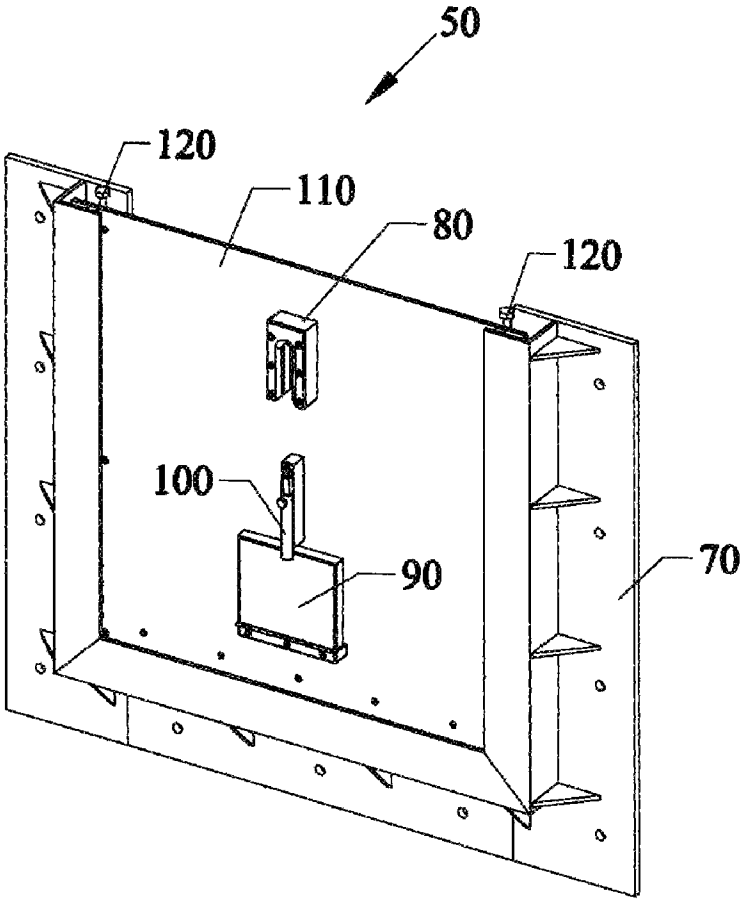
FIG. 9 is a front perspective view of the damper panel system of FIG. 5.

FIG. 9 is a front perspective view of the damper panel system 50 of FIG. 5 showing the pressure relief door 90, pressure relief door release latch 100 and panel lifting cleat 80.

Figure 10:
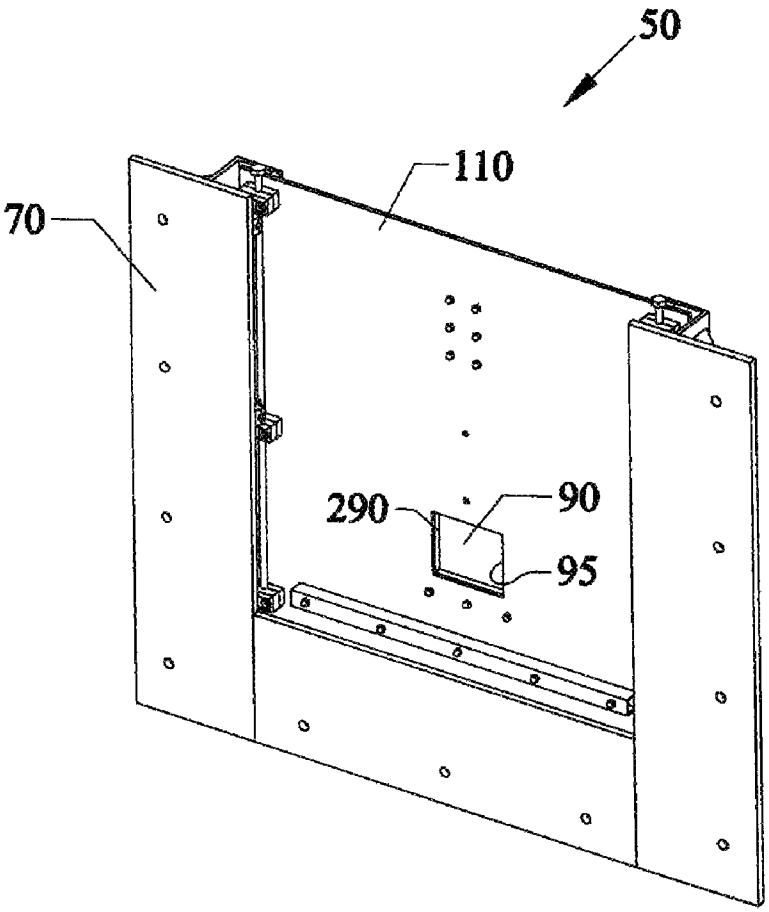
FIG. 10 is a rear perspective view of the damper panel system of FIGS. 5 and 9.

FIG. 10 is a rear perspective view of the damper panel system 50 of FIGS. 5 and 9 showing the other side of the pressure relief door 90 closing off the opening 95, and foam sealing strip 290 about the opposite perimeter edge of the opening 95 and door 90.

Figure 11:
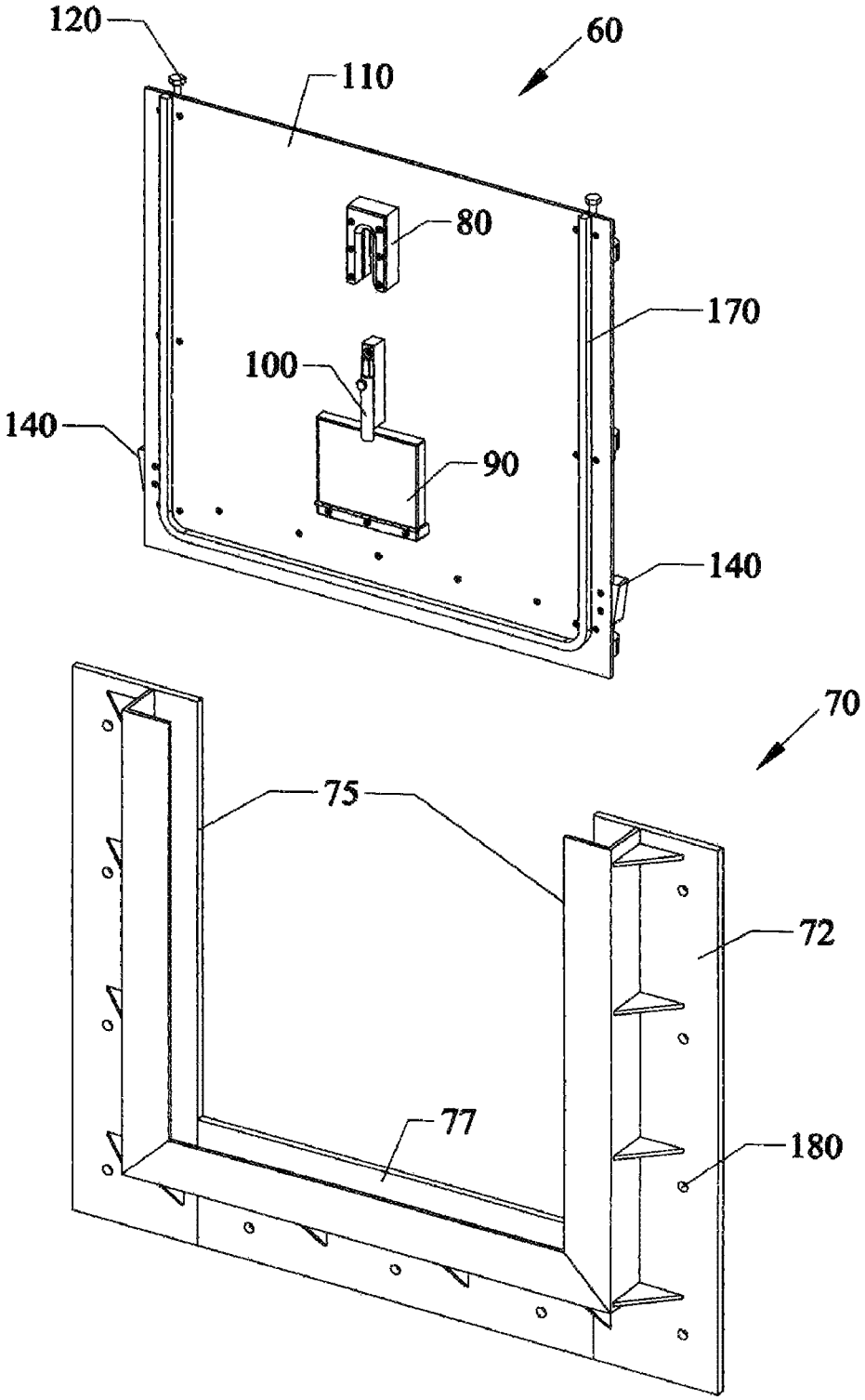
FIG. 11 is a front perspective exploded view of the damper panel system of FIGS. 5 and 9 with damper panel removed.

FIG. 11 is a front perspective exploded view of the damper panel system 50 of FIGS. 5 and 9 with damper panel removed, where the damper panel guide bushings 140 are visible, and the foam sealing strip 170 is shown in a U-shaped pattern about the perimeter edge of the door panel 110.

Figure 12:
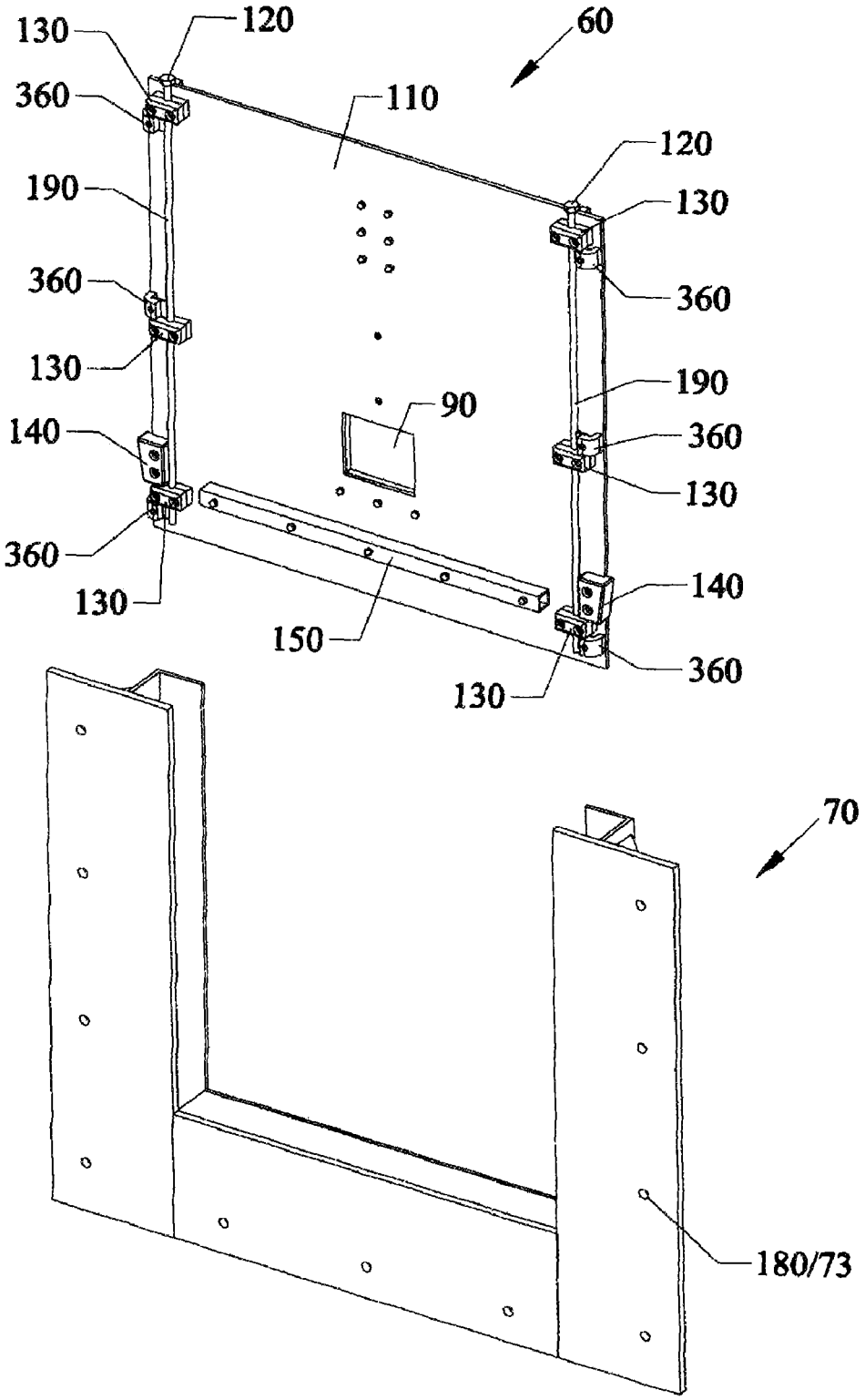
FIG. 12 is a rear perspective exploded view of the damper panel system of FIG. 11 with damper panel removed.
Figure 14:
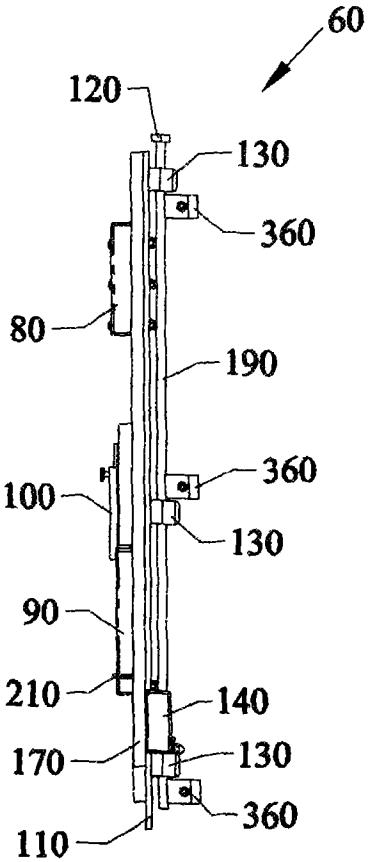
FIG. 14 is a side view of the damper panel assembly of FIG. 13.
Figure 13:
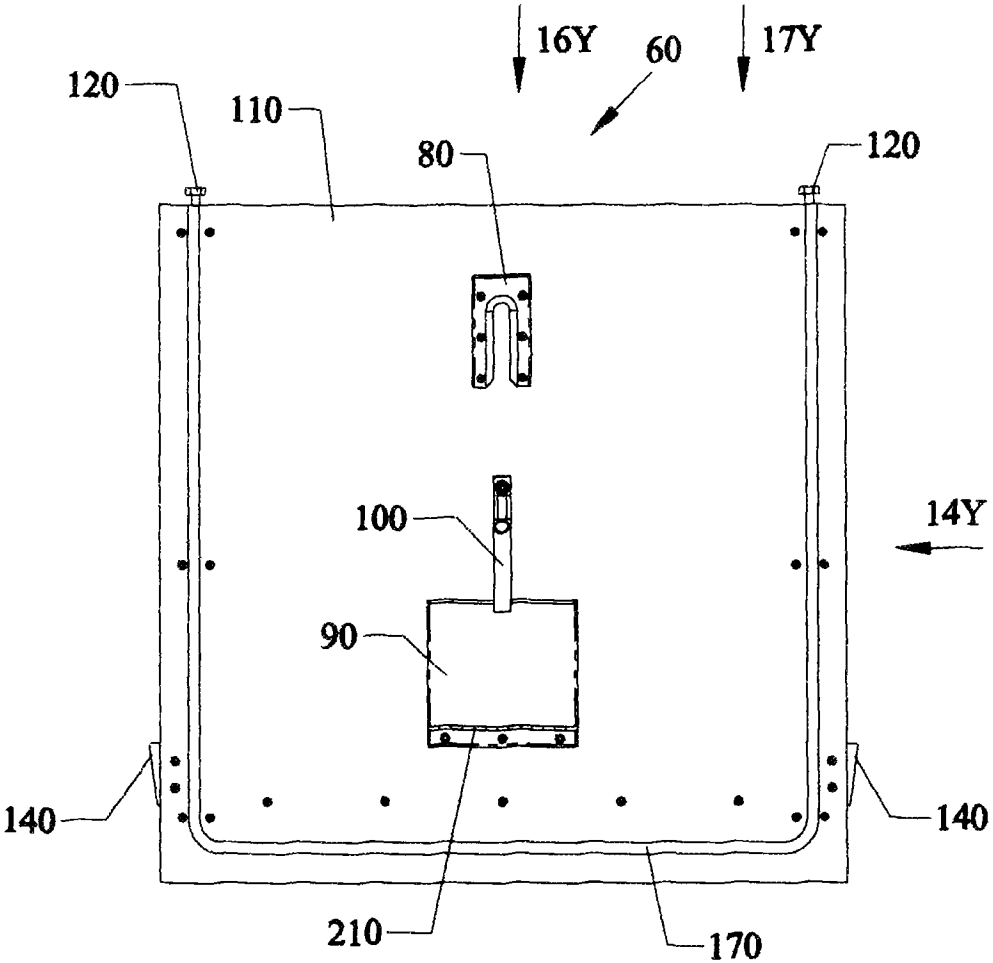
FIG. 13 is a front view of the damper panel assembly used in the damper panel system of the preceding figures.
Figure 15:
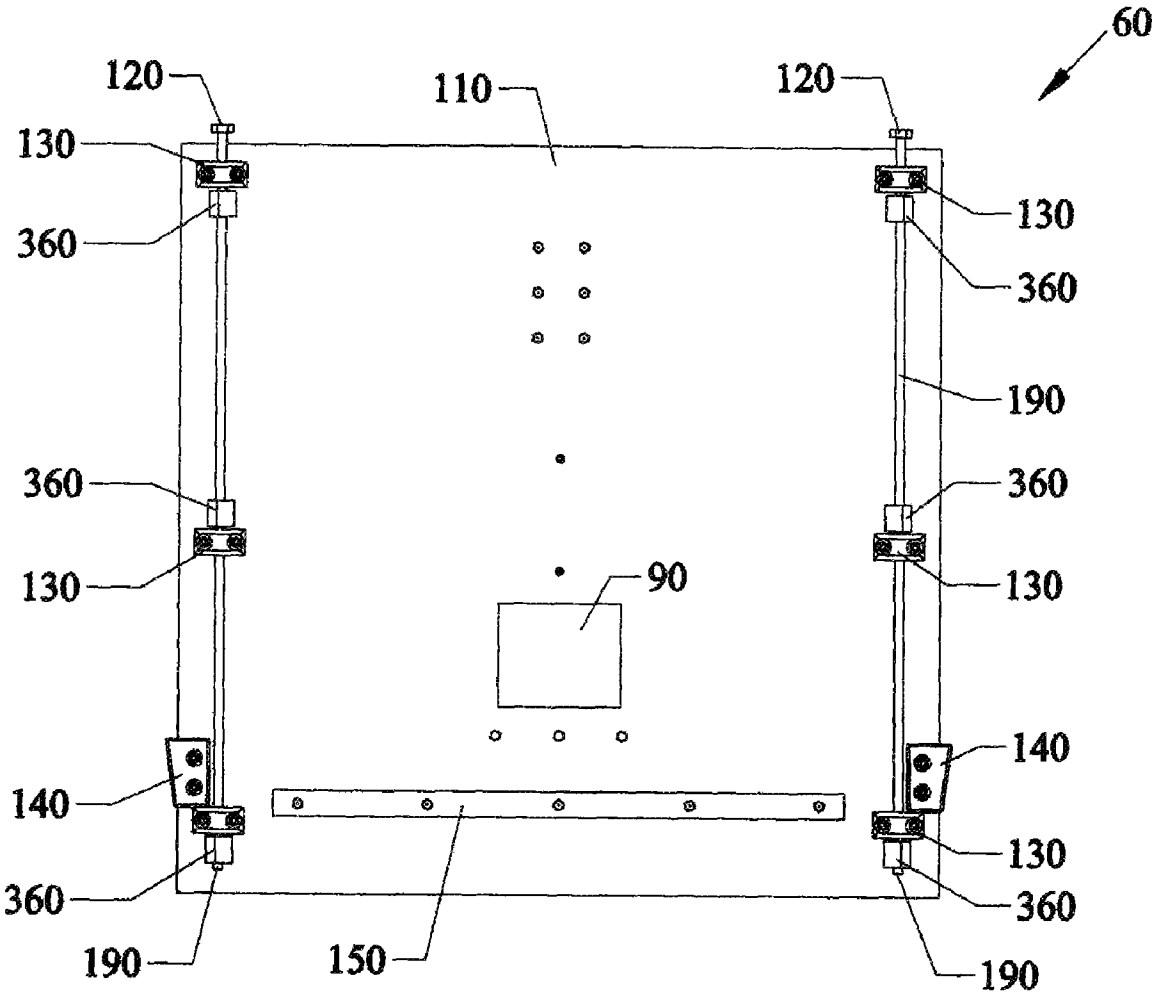
FIG. 15 is a rear view of the damper panel assembly of FIG. 13.
Figure 16:
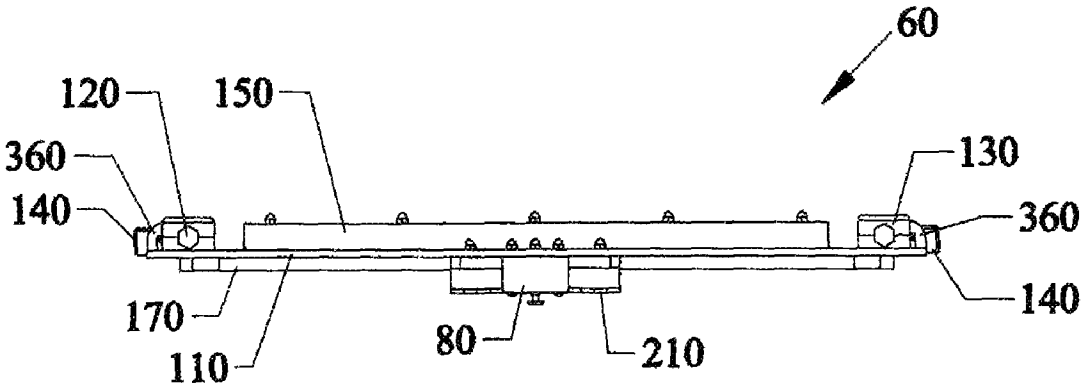
FIG. 16 is a top view of damper panel assembly of FIG. 13 along arrow 16Y with cam-locks unlocked.
Figure 17:
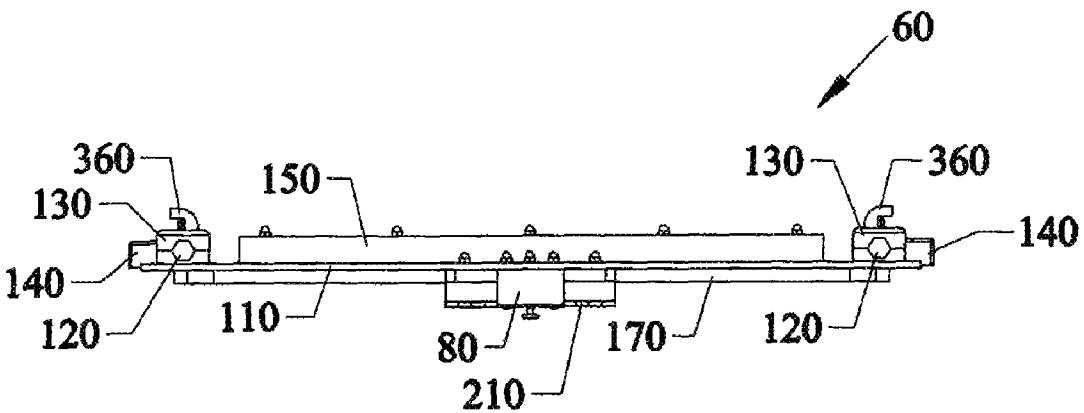
FIG. 17 is a top view of damper panel assembly of FIG. 13 along arrow 17Y with cam-locks locked.
Figure 19:
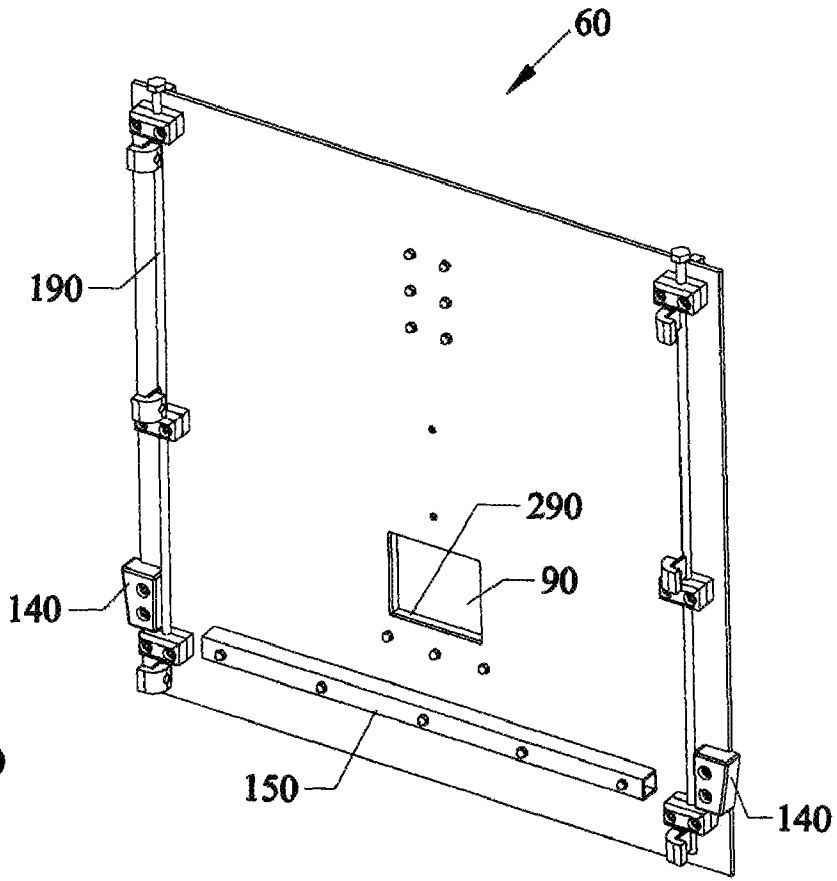
FIG. 19 is a rear perspective view of the damper panel assembly of FIG. 18.
Figure 18:
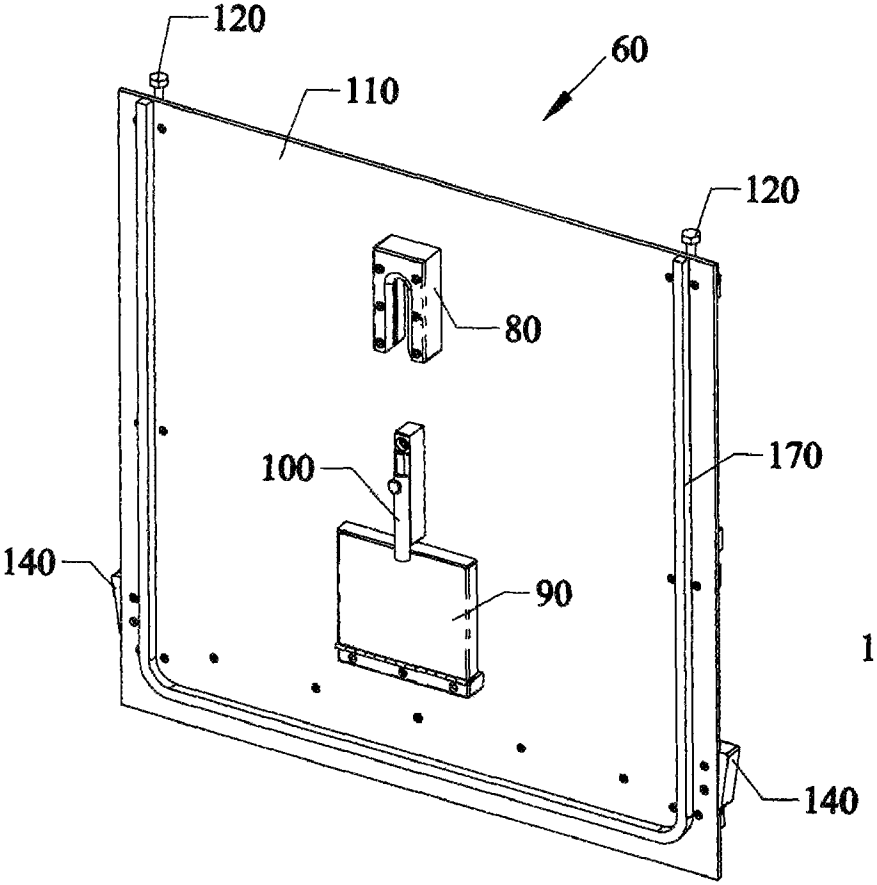
FIG. 18 is front perspective view of the damper panel assembly of FIG. 13.

FIG. 12 is a rear perspective exploded view of the damper panel system 50 of FIG. 11 with damper panel 110 removed from the frame assembly 70, and the damper frame mounting hole(s) 180 which is equivalent to the through-holes 73 previously described. FIG. 13 is a front view of the damper panel assembly 60 used in the damper panel system 50 of the preceding figures. FIG. 14 is a side view of the damper panel assembly 60 of FIG. 13. FIG. 15 is a rear view of the damper panel assembly 60 of FIG. 13. FIG. 16 is a top view of damper panel assembly 60 of FIG. 13 along arrow 16Y with cam-locks 360 unlocked. FIG. 17 is a top view of damper panel assembly 60 of FIG. 13 along arrow 17Y with cam-locks locked. FIG. 18 is front perspective view of the damper panel assembly 60 of FIG. 13. FIG. 19 is a rear perspective view of the damper panel assembly 60 of FIG. 18.

Referring to FIGS. 12-21, a pair of damper panel lock release hexes 120 can be located on adjacent to the top ends of the panel 110 of the damper panel assembly 60. Each of the release hexes 120 can be fixably attached to lock release bars 190 that run parallel to one another. Each of the bars can be attached to the panel 110 by up to three lock release bar mounts 130. Each of the bars 190 can include damper panel cam locks 360 fixably attached thereto, so that when the bars 190 rotate the cam locks 360 rotate. In a preferred embodiment there can be three cam locks 360 each adjacent to each of the three bar mounts 130.

As previously described damper panel guide bushings 140 can be attached adjacent to the side edges of the panel 110, and include portions (such as triangular shape) that protrude outward. In a preferred embodiment, the bushings can have a wedge shape protruding portion which allows the panel 110 to slide downward while the bushings 140 help wedge (see for example FIG. 15) the panel 110 in place.

Figure 20:
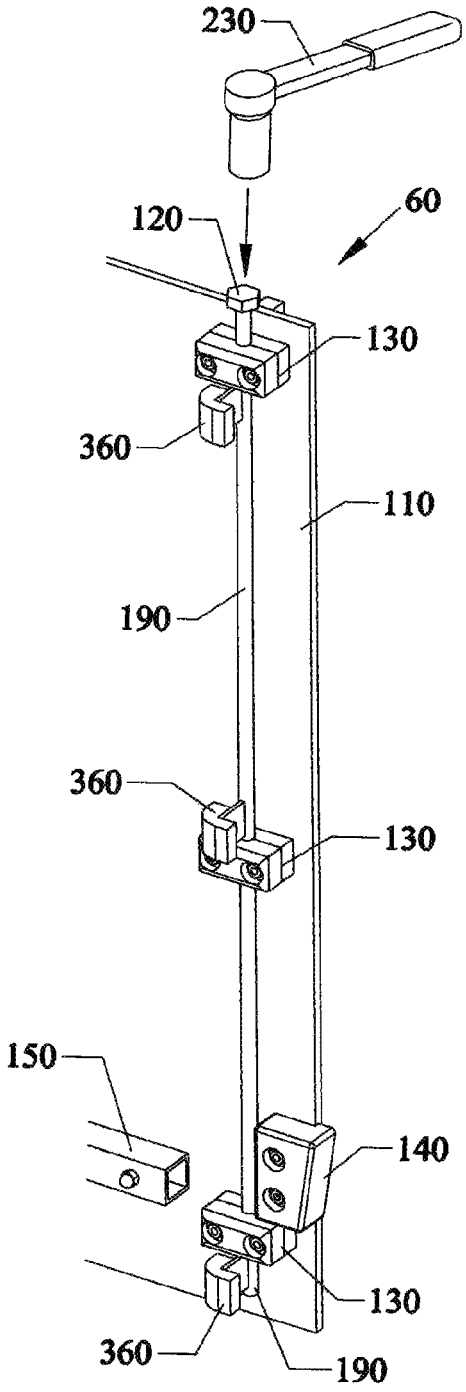
FIG. 20 is an enlarged rear perspective partial detail view of damper panel locking system used in the damper panel assembly of FIG. 19 in a locked configuration.
Figure 21:
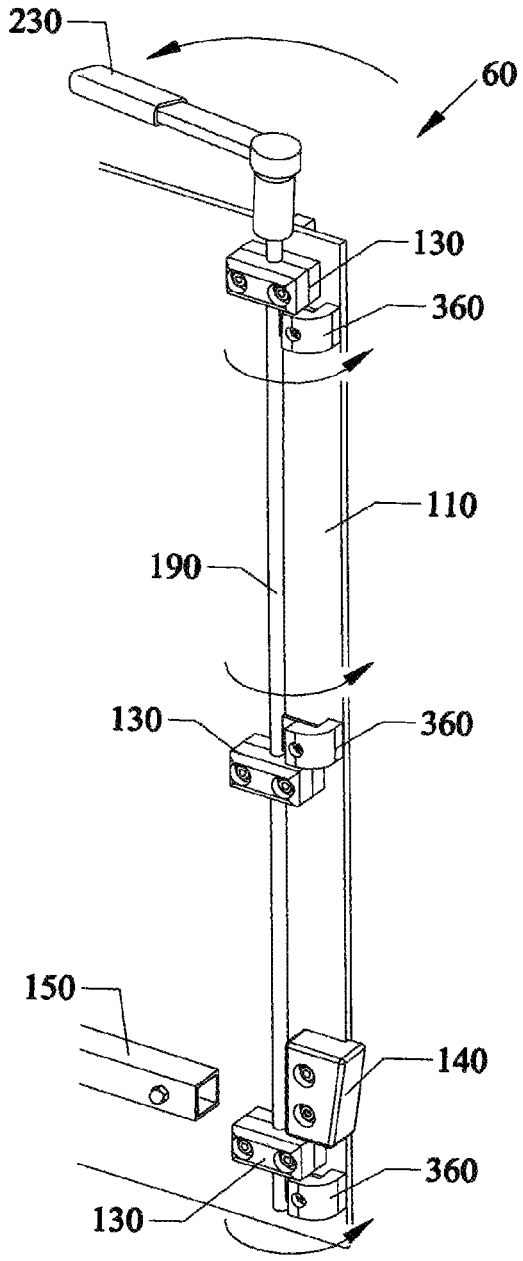
FIG. 21 is an enlarged rear perspective partial detail of FIG. 20 showing the damper panel locking system in an unlocked configuration.

FIG. 20 is an enlarged rear perspective partial detail view of damper panel locking system used in the damper panel assembly 60 of FIG. 19 in a locked configuration. FIG. 21 is an enlarged rear perspective partial detail of FIG. 20 showing the damper panel locking system in an unlocked configuration.

Referring to FIGS. 20-21, a socket wrench 230 (as an alternative to the wrench 160 previously described) can also be used to release the panel lock hex nut 120. As previously described, the wrench 230 can be fit about release hex 120. Rotating the wrench 230 counter-clockwise rotates bar 190 with fixably attached damper panel cam-lock(s) 360 counter-clockwise as well, which moves the panel 110 from a locked configuration to an unlocked configuration. Rotating the hex (s) 120 clockwise allows the cam lock(s) 360 to extend outward from the panel 110 locking the panel in place in the track 75 of the frame 71 (shown in the previous FIGS. 7, 7A, 8, 8A.

Figure 22A:
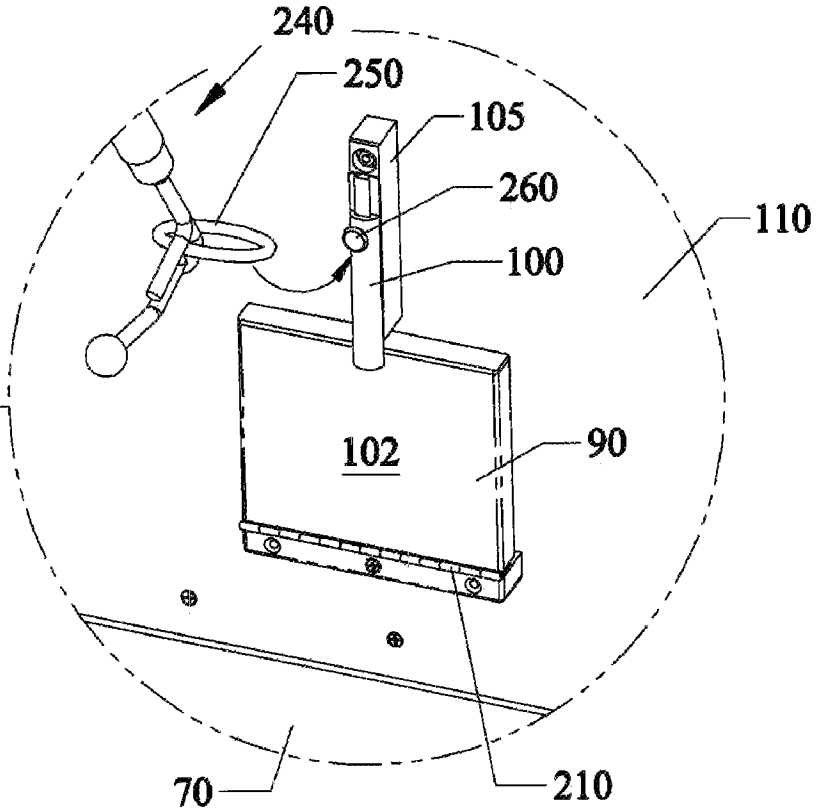
FIG. 22A is an enlarged view of the pressure relief door of FIG. 22.
Figure 22:
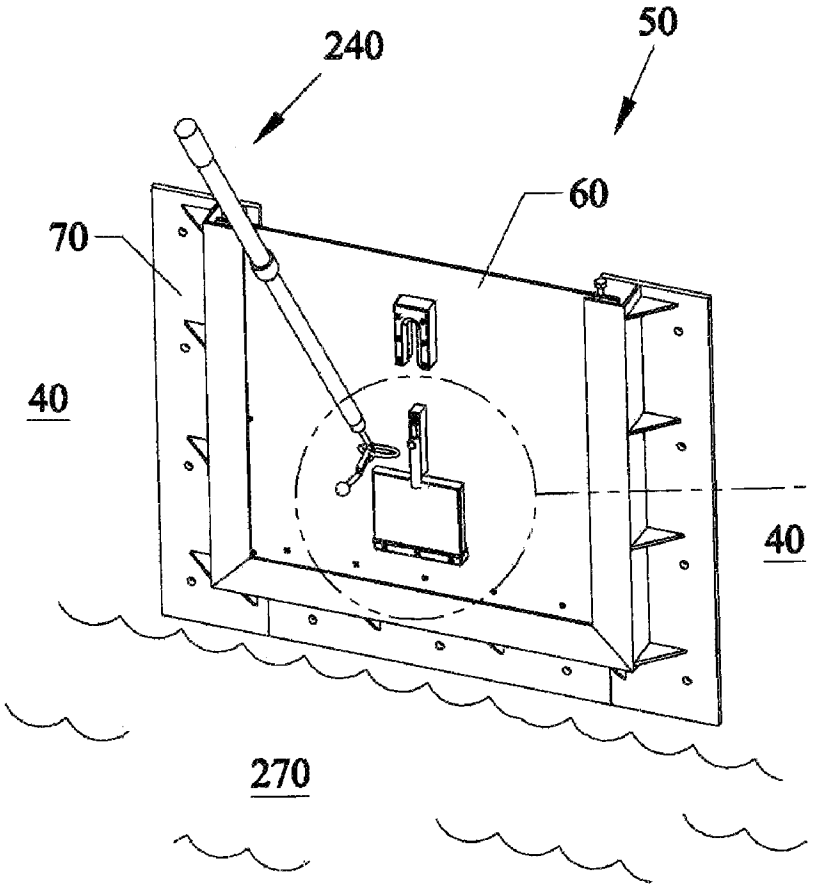
FIG. 22 is a front perspective of the damper system of the preceding figures installed into vault, with the pressure relief door about to be unlatched.
Figure 23A:
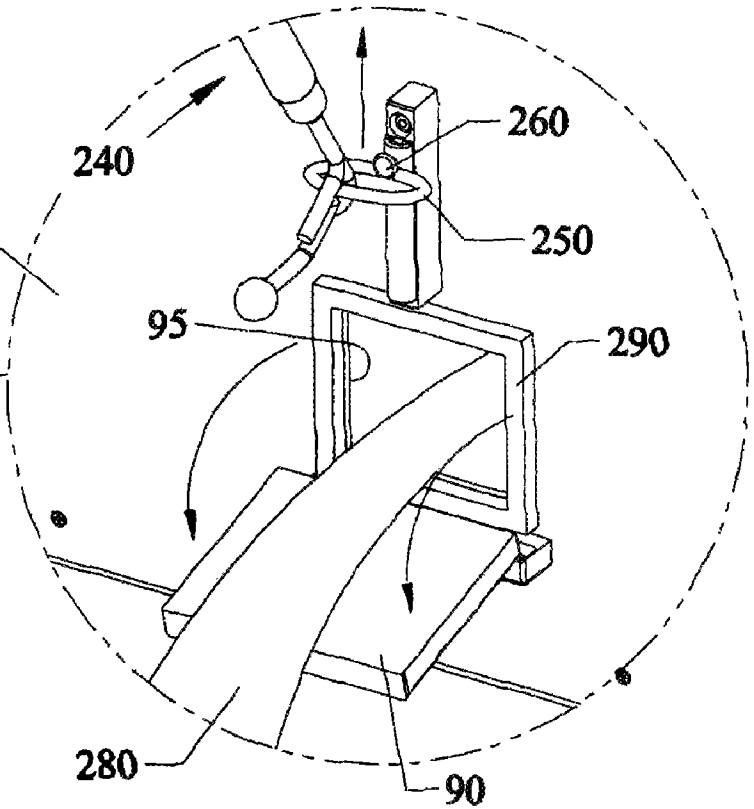
FIG. 23A is an enlarged view of the unlatched pressure relief door of FIG. 23.
Figure 23:
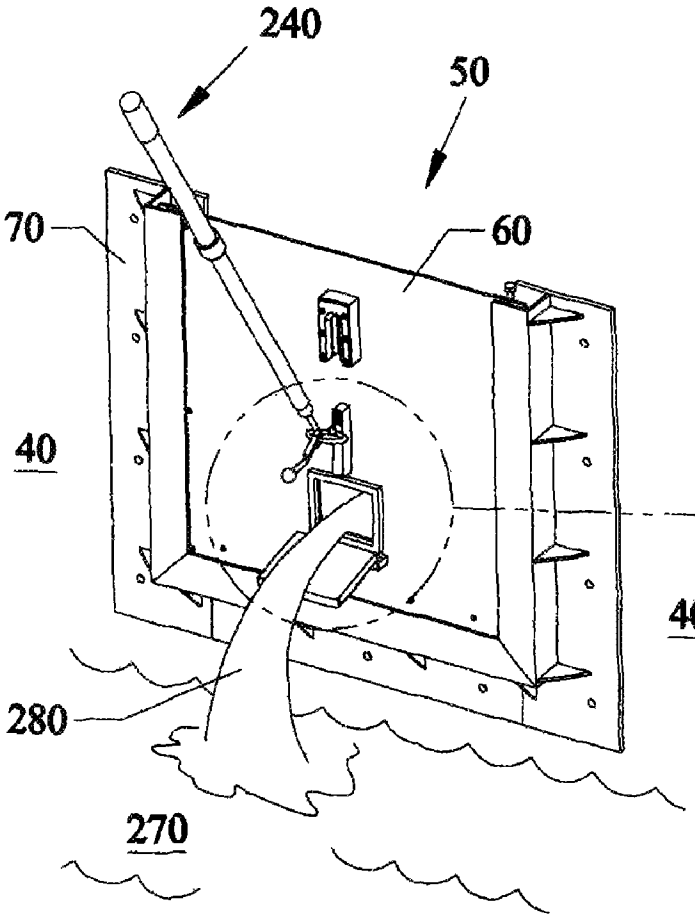
FIG. 23 is a front perspective view of the installed damper system of FIG. 22 showing the unlatching of the pressure relief door, where water is flowing from the storm water inlet to equalize the pressures on both sides of the damper panel so the panel can be unlocked and removed.

FIG. 22 is a front perspective of the damper system 50 of the preceding figures installed against a vault wall 40, with the pressure relief door 90 about to be unlatched. FIG. 22A is an enlarged view of the pressure relief door 90 of FIG. 22 and hinge 210. FIG. 23 is a front perspective view of the installed damper system 50 of FIG. 22 showing the unlatching of the pressure relief door 90, where water 280 is flowing from the storm water inlet to equalize the pressures on both sides of the damper panel 110 so it can be unlocked and removed. FIG. 23A is an enlarged view of the unlatched pressure relief door 90 of FIG. 23 with storm water 280 flows through the open relief door 90 to equalize pressure.

FIG. 29 is a perspective view of the Hook/Ring tool 240. FIG. 29A is an enlarged view of the hook and ring portion of the tool 240 of FIG. 29. FIG. 30 is a side view of the Hook/Ring tool 240. FIG. 30A is an enlarged view of the hook and ring portion of the tool 240 of FIG. 30. The hook/ring tool 240 can include a telescoping tube handle 340 to allow for remote operation of the tool 240 by a handler so that the tool 240 can be lengthened or shortened. The lower part of the tool 240 can include a steel ball 330 projecting from a support bar 332 at an angle from the bottom of the tool 240. A ring 250 can be angled off the bottom of the tool 240 in an opposite direction.

Referring to FIGS. 22, 22A, 23, 23A and 29, 29A, 30 and 30A, a handler can grip the top of the telescoping handle 340 of the tool 240. The ring 250 can be oriented to hook onto the latch knob 260 on the slidable pressure relief door release latch 100 were the latch can be slid upward in tracks on an outside of the base 105 that can be attached to the panel 110 by fasteners, such as bolts, screws, rivets, and the like. Once the lower edge 102 of the latch 100 rises above the door 90, then the door 90 can rotate open by hinge 210, and allow water to flow through opening 95 in the panel 110.

Figure 24A:
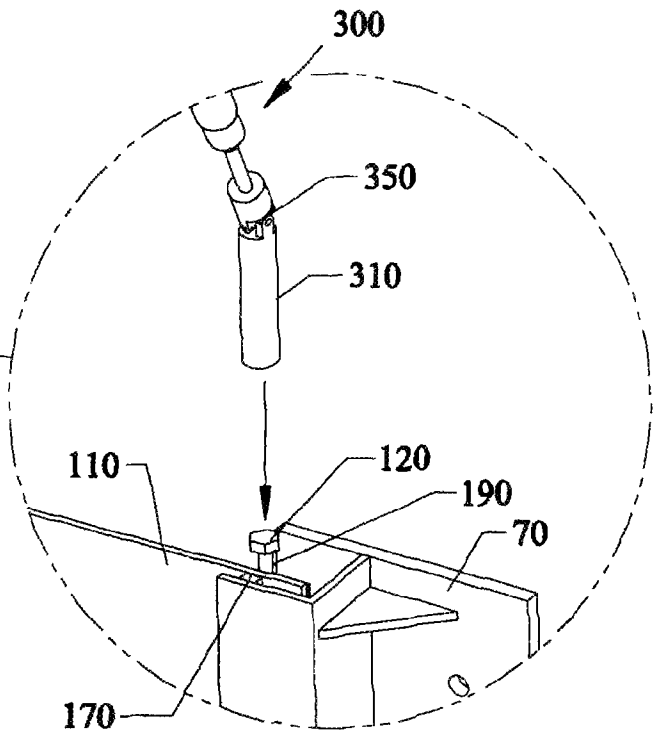
FIG. 24A is an enlarged view of the locking mechanisms of FIG. 24.
Figure 24:
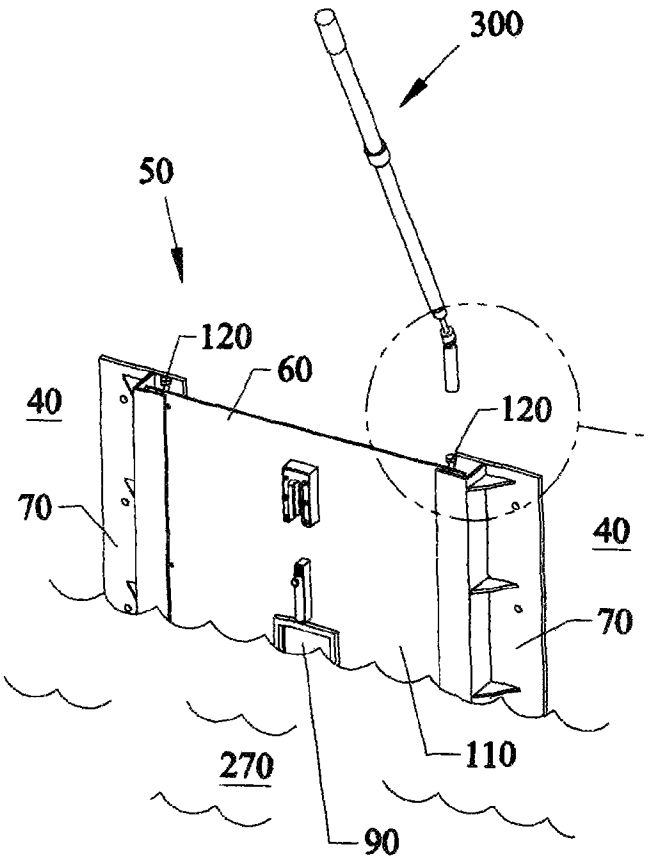
FIG. 24 is an upper perspective view of the installed damper system where pressure on both sides of the damper panel has equalized and the locking mechanisms are now going to be unlocked for panel removal.

FIG. 24 is an upper perspective view of the installed damper system 50 where pressure on both sides of the damper panel 110 of the damper panel assembly 60 has equalized after the pressure release door 90 has been opened and the locking mechanisms 120 are now going to be unlocked for removal of the panel 110. Storm water 270 is filled inside of the vault. FIG. 24A is an enlarged view of the locking mechanisms 120 of FIG. 24.

Figure 25A:
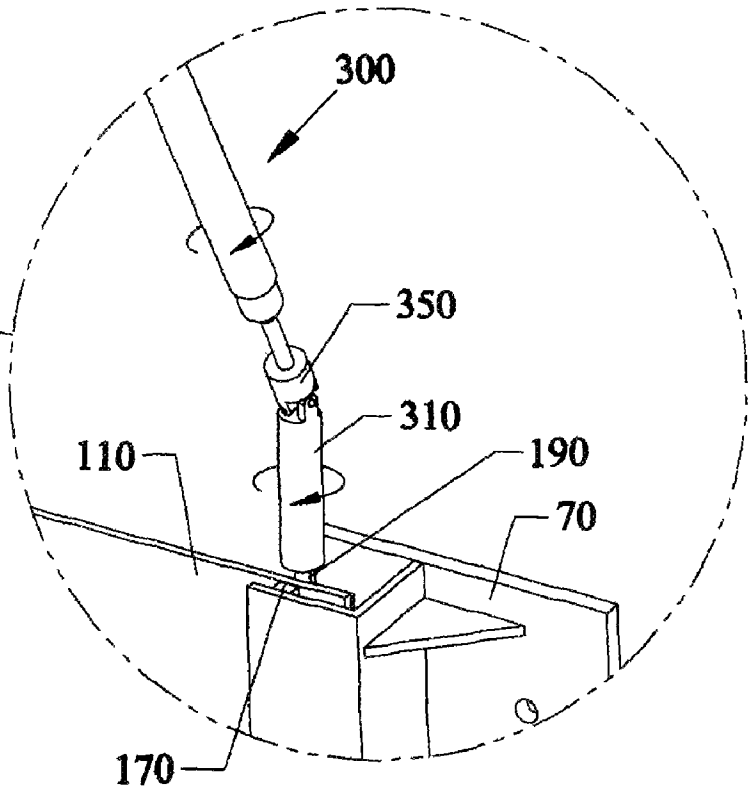
FIG. 25A is an enlarged view of the socket tool and lock relief hex and bar of FIG. 25.
Figure 25:
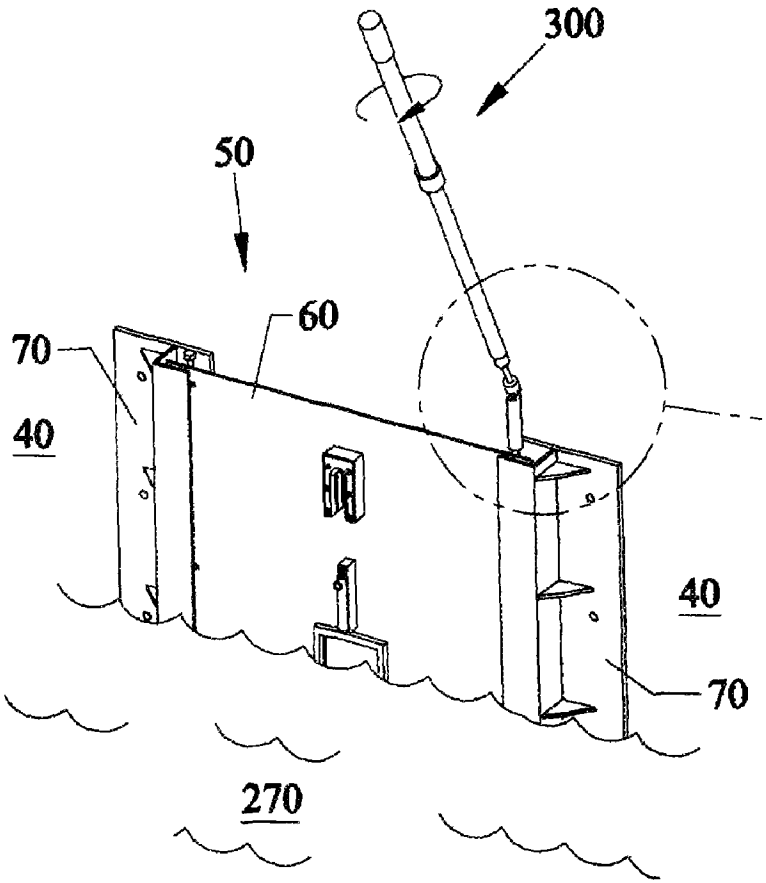
FIG. 25 is an upper perspective view of the installed damper system where the remote socket wrench tool is used to turn the lock release hex on the top of the lock release bar. This turns the locking cams which releases the panel from the frame.

FIG. 25 is an upper perspective view of the damper system 50 installed on the inner wall 40, where the remote socket wrench tool 300 is used to turn the lock release hex 120 on the top of the lock release bar 190. This turns the locking cams (360 shown rotating in FIGS. 7, 7A, 8, 8A) which releases the panel 110 from the frame assembly 70. FIG. 25A is an enlarged view of the socket tool 300 with universal joint for all angle operation, and socket 310 which fits over and locks damper panel lock release hex 120.

FIG. 31 is a side view of the remote socket wrench tool 300 which includes a telescoping tube handle 340 that can be used for the remote socket wrench 310. FIG. 31A is an enlarged view of the socket wrench portion of the universal joint 350 for all angle operation socket 310 of the tool of FIG. 31. FIG. 32 is a perspective view of the remote socket wrench tool 300 of FIG. 31. FIG. 32A is an enlarged view of the socket wrench portion 310, 350 of FIG. 32.

Referring to FIGS. 7, 7A, 8 and 8A, 24, 24A, 25, 25A, 31, 31A, 32 and 32A, rotating the socket wrench tool 300 clockwise, causes the damper panel locks 360 to move from a panel locking position of being pushed against and compressing foam sealing strip 170 to an unlocking position where the panel 110 is now loosely held in the framing assembly 70.

Figure 26A:
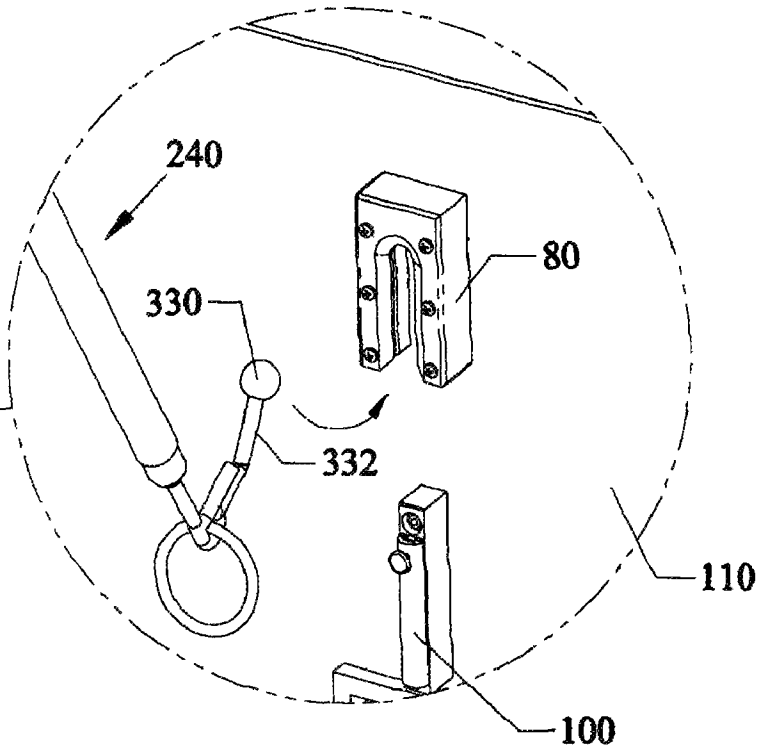
FIG. 26A is an enlarged view of the remote Hook/Ring tool and panel portion of FIG. 26.
Figure 26:
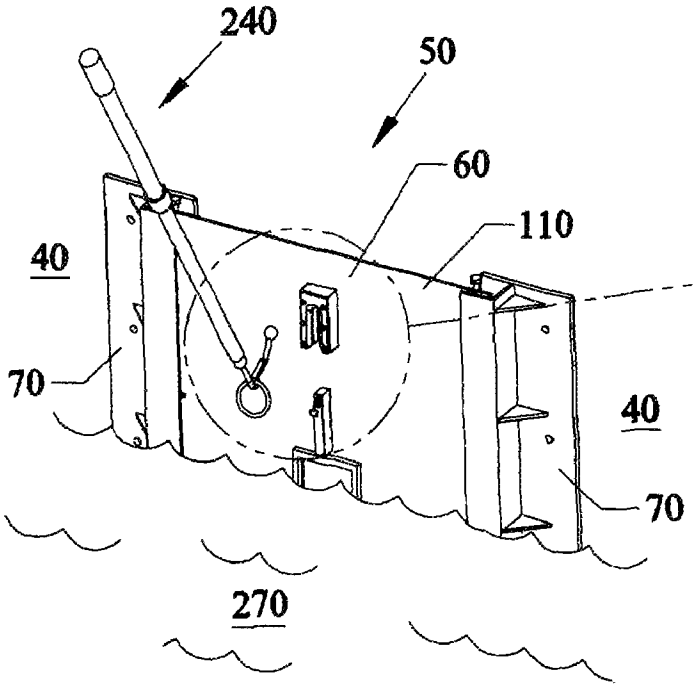
FIG. 26 is an upper perspective view of the installed damper system where the panel is now released from the frame and is ready to be lifted free of the frame using the remote Hook/Ring tool.

FIG. 26 is an upper perspective view of the wall (40) installed damper system 50 where the panel 110 is now released from the frame assembly 70 and is ready to be lifted free of the frame assembly 70 using the remote Hook/Ring tool 250. FIG. 26A is an enlarged view of the remote Hook/Ring tool 240 and portion of panel 110 of FIG. 26. FIG. 27 is an upper perspective view of the installed damper system 50 where the hook 332 with ball tip 330 (such as an approximately 1 inch diameter metal sphere, such as a stainless steel ball, and the like) of the Hook/Ring tool is slipped into the panel lifting cleat 80.

Figure 27A:
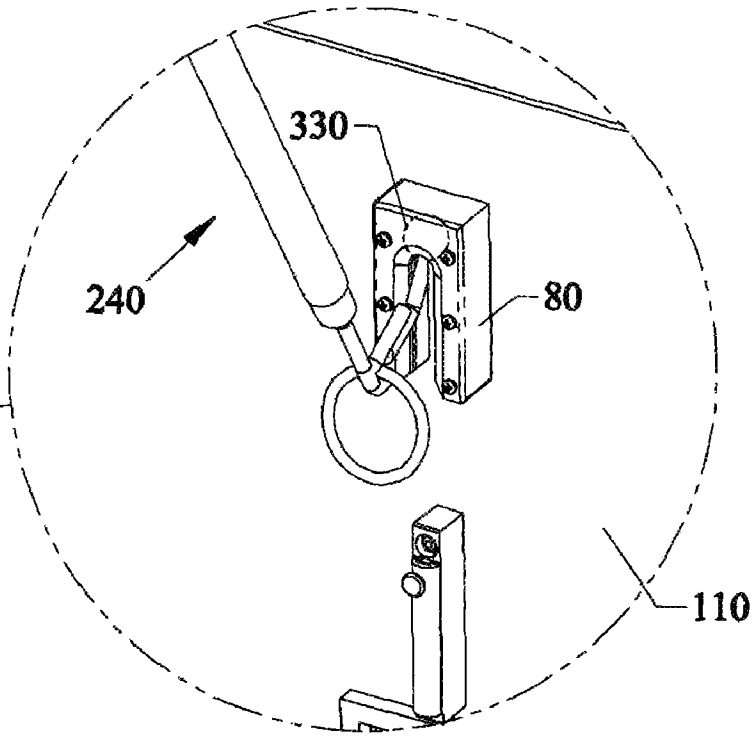
FIG. 27A is an enlarged view of the Hook/Ring tool and panel lifting cleat of FIG. 27.
Figure 27:
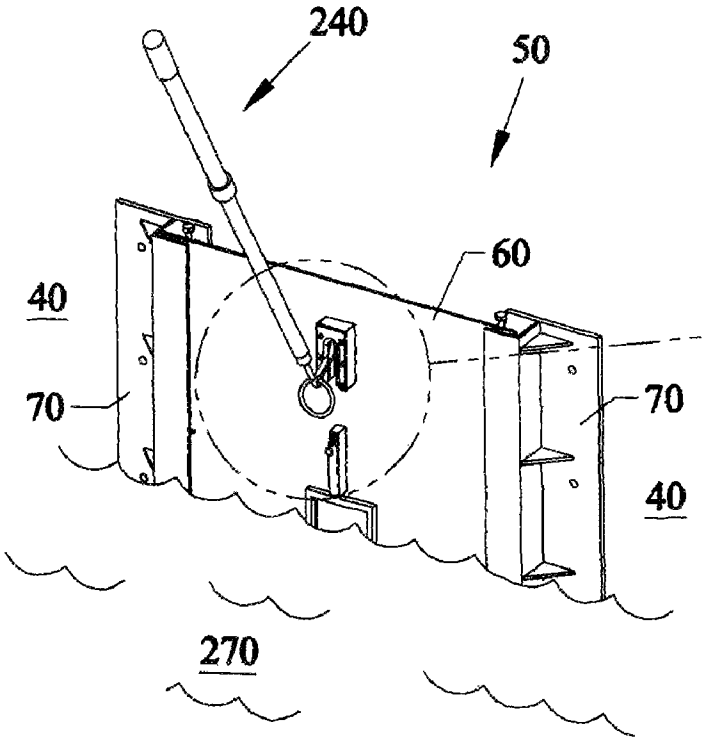
FIG. 27 is an upper perspective view of the installed damper system where the hook of the Hook/Ring tool is slipped into the panel lifting cleat.
Figure 28:
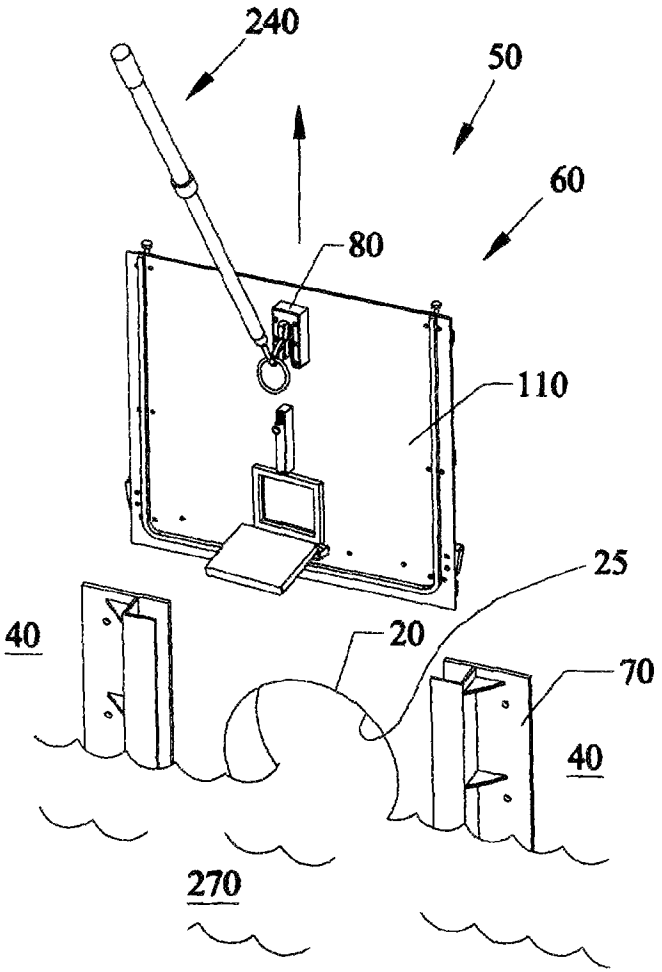
FIG. 28 is an upper perspective view of the installed damper system where the panel is lifted free of the frame and full flow from the storm water inflow is restored.

FIG. 27A is an enlarged view of the Hook/Ring tool 240 and panel lifting cleat 80 of FIG. 27. FIG. 28 is an upper perspective view of the installed damper system 50 where the panel 110 is lifted free of the frame assembly 70 and full flow from the storm water inflow 20 is restored through vault/structure inlet 25.

The panel 110 and damper panel assembly 60 can be installed back into the frame assembly 70 by operating the above tools and the related components (hexes 120 and cam locks 360) in reverse order.

Although separate cams shown attached to the rotatable bars, a single rotatable cam can be used which can simultaneously push along substantially all of one perimeter side edge of the door panel.

Figure 33A:
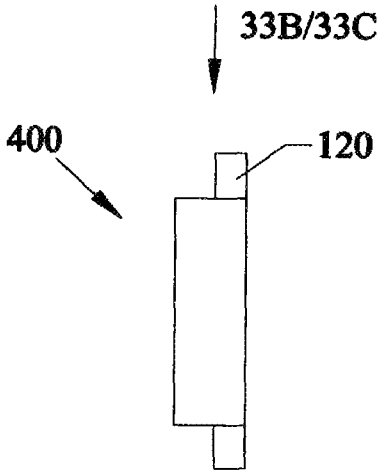
FIG. 33A is a side view of a single rotatable cam embodiment.

FIG. 33A is a side view of a single rotatable cam embodiment 400 having rotatable ends that can be rotated by release nut type hexes 120, that can be used instead of the plural cam locks (360 shown for example in FIGS. 12, 14, 15).

Figure 33B:
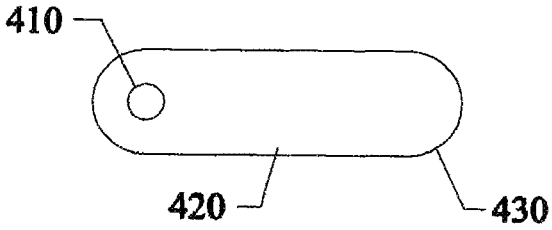
FIG. 33B is a top view of a paddle version of the single rotatable cam of FIG. 33A along arrow 33B.
Figure 33C:
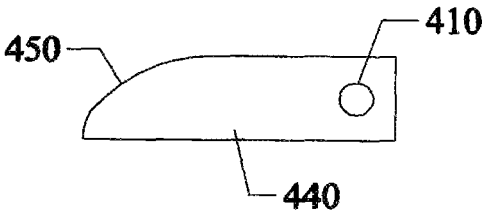
FIG. 33C is a top view of a wedge configuration of the single rotatable cam of FIG. 33A along arrow 33B.

FIG. 33B is a top view of a paddle version 420 of the single rotatable cam of FIG. 33A along arrow 33B with a rounded tip end 430 opposite a pivot axis 410. FIG. 33C is a top view of a wedge configuration 440 of the single rotatable cam of FIG. 33A along arrow 33B with a half curved tip end 450. Referring to FIGS. 33A-33C, each side of the door panel 110 can have a single rotatable cam embodiment 400 so that an entire left side or an entire right side of the panel 110 can be compressed and water sealed in place by actuating the rotating of the upper end 410 of the single rotatable cam(s) 400.

Figure 34:
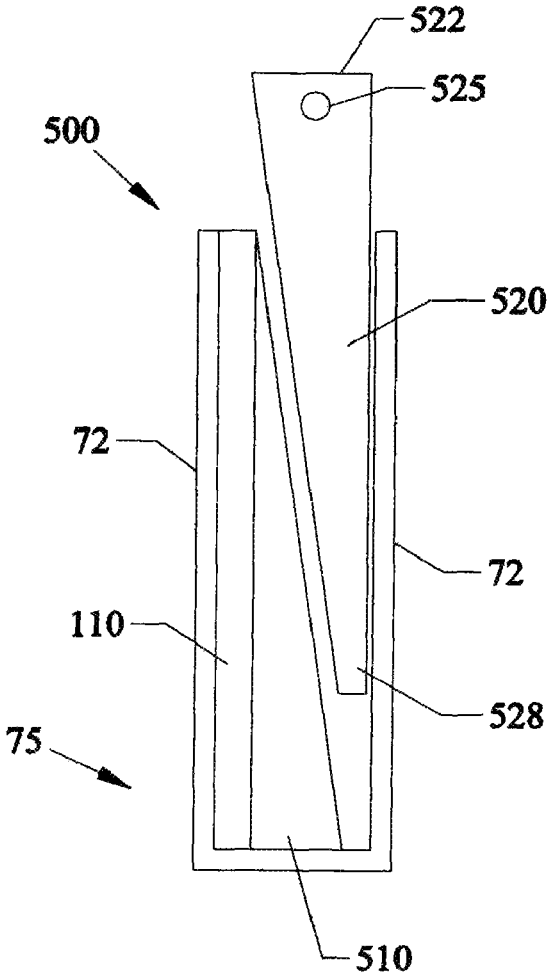
FIG. 34 is a side partial cross-sectional view of an alternative removable wedge embodiment for compressing and water sealing the damper panel in the parallel tracks.

FIG. 34 is a side partial cross-sectional view of an alternative removable wedge embodiment 500 for compressing and water sealing the damper panel within the U-shaped plates 72 in the parallel tracks 75 on both the left and right sides of the damper panel 110. A first wedge 510 having a triangular shape with a base on the lower end of the tracks 75 and an upper narrow tip end can be fixably attached to rear side edges of the damper panel 110. The user can compress the damper panel 110 in place by pushing the blunt base end 522 of the removable triangular wedge 520 so that the narrow tip end 528 is on the lower end being pushed down. The two wedges 510 and 520 will compress and water seal the edges of the damper panel 110 in place. Removable wedge 520 can be removed by hooking onto opening 528 in the base end and pulling up the wedge 520 Either or both wedges 510 and 520 can be formed from solid materials such as metal, plastic and the like. Alternatively, either or both the wedges 510, 520 can be formed from compressible material such as rubber, elastomeric and the like, to enhance the water sealing effect of the wedges once they are installed in place.

In a preferred application the novel damper system can be used to isolate a stormwater treatment structure from unwanted water inflow during treatment servicing so that a vacuum such as vacuum truck deals with the contents of the treatment structure at the beginning of the service.

While the compressible seal has been described as elongated seal member, the seal can include a gasket member having a C or E or U type channel that compresses. The seal can also include resilient and/or elastomeric type members, and the seal can be an inflatable bladder type tube(s), and the like. Additionally, the seal can be placed along the bottom edge of the panel as well as the left and right sides of the panel. In a preferred embodiment, the seal member is placed on the opposite side of the panel from the inlet port to the vault or structure.

Although preferred types of tools are described, the invention can use other types of tools for opening the pressure relief door and to lift the sliding door, such as using a manhole hook tool, and the like.

While the latch has been described as having a knob, the latch can have a catch portion such as an indented or cut-out or lip edge, that can also be snagged or hooked to open the pressure relief door.

Although the invention refers to wrenches, the invention can work with lever arms that are fixably attached to the tops of the cam bars, or are removably attached as needed.

Although the invention is described for use with storm water treatment vaults and structures, the invention can have other applications, such as but not limited to being used in dam type applications, and the like for ponds, lakes, pools, waterfalls, and the like.

While the invention has been described, disclosed, illustrated and shown in various terms of certain embodiments or modifications which it has presumed in practice, the scope of the invention is not intended to be, nor should it be deemed to be, limited thereby and such other modifications or embodiments as may be suggested by the teachings herein are particularly reserved especially as they fall within the breadth and scope of the claims here appended.

I claim:

1. A damper system for storm water treatment vault structures, comprising:

a frame attached to an inner wall of a vault structure, the frame having an opening therethrough;

tracks attached to the frame about the opening;

a door slidably received within the tracks, the door having an open position for allowing water to pass into the vault structure and a closed position for preventing water from passing into the vault structure; and moveable members along one side face of the door for pushing the door against portions of the tracks to seal the door against water intrusion, wherein the moveable members include:

a left vertical bar member rotatably mounted by at least one left bar mount only to the door adjacent to a left side of the door;

a right vertical bar member rotatably mounted by at least one right bar mount only to the door adjacent to a right side of the door, the left vertical bar member and the right vertical bar member each having a longitudinal axis;

a plurality of spaced apart left cams each mounted to extend horizontal and perpendicular to the left vertical bar member, the plurality of spaced apart left cams including an upper left cam mounted adjacent to an upper left corner of the door and a lower left cam mounted adjacent to a lower left corner of the door; and a plurality of spaced apart right cams each mounted to extend horizontal and perpendicular to the right vertical bar member, the plurality of spaced apart right cams including an upper right cam mounted adjacent to an upper right corner of the door and a lower right cam mounted adjacent to a lower right corner of the door, wherein rotating the left vertical bar member and the right vertical bar member rotates the left cams and the right cams in a horizontal axis from an unlocked position where the door is loosely seated in the tracks and a locked position where the door is pushed against one side of the tracks by the left cams and the right cams, wherein the locked position prevents the water from passing about edges of the door.

2. The damper system of claim 1, further comprising:

a hand wrench for rotating the cams from the unlocked to the locked position.

3. The damper system of claim 1, wherein the removable tool includes:

a socket wrench for rotating the cams from the unlocked to the locked position.

4. The damper system of claim 1, further comprising:

bushings along both the left perimeter side edge and the right perimeter side edge of the door, the bushings for guiding the cam and wedging the door in the tracks.

5. The damper system of claim 1, further comprising: elongated seal members between perimeter edges of the door and the one side of the track, wherein the cams in the locked position causes the door to compress the elongated sealing members against the one side of the tracks so that the water is sealed and prevented from entering about the perimeter edges of the door.

6. The damper system of claim 1, further comprising:

a pressure release door attached to the one face of the sliding door, the pressure release door for being selectively opened to allow equalization of the water on both sides of the sliding door.

7. The damper system of claim 6, further comprising:

a hinge along an edge of the pressure release door for allowing the pressure release door to swing open.

8. The damper system of claim 7, further comprising:

a slidable latch for locking the pressure release door in a closed position, the latch having an opening member for allowing the latch to slide.

9. The damper system of claim 8, further comprising:

an elongated tool having an end portion that can attach and detach to the opening member on the slidable latch.

10. The damper system of claim 1, further comprising:

a cleat member attached to one side of the door.

11. The damper system of claim 10, further comprising:

an elongated handle having a hook end for attaching to the cleat member, wherein lifting the handle raises the door from the tracks, and allows the storm water to enter into the vault structure.

12. The damper system of claim 1, wherein the moveable members include: removable triangular wedges that push the door in place.

13. The damper system of claim 1, wherein the plurality of spaced apart left cams further includes a middle left cam located midway between the upper left cam and the lower left cam; and wherein the plurality of spaced apart right cams includes a middle right cam located midway between the upper right cam and the lower right cam.

14. A damper system for storm water treatment vault structures, comprising:

a frame attached to an inner wall of a vault structure, the frame having an opening therethrough;

tracks attached to the frame about the opening;

a door slidably received within the tracks, the door having an open position for allowing water to pass into the vault structure and a closed position for preventing water from passing into the vault structure;

moveable members along one side face of the door for pushing the door against portions of the tracks to seal the door against water intrusion;

a pressure release door attached to the one face of the sliding door, the pressure release door for being selectively opened to allow equalization of the water on both sides of the sliding door; and a hinge on along an edge of the pressure release door for allowing the pressure release door to swing open.

15. A damper system for storm water treatment vault structures, comprising:

a frame attached to an inner wall of a vault structure, the frame having an opening therethrough;

tracks attached to the frame about the opening;

a door slidably received within the tracks, the door having an open position for allowing water to pass into the vault structure and a closed position for preventing water from passing into the vault structure; and moveable members along one side face of the door for pushing the door against portions of the tracks to seal the door against water intrusion, wherein the moveable members include:

a left vertical bar member rotatably mounted by at least one left bar mount only to the door adjacent to a left side of the door;

a right vertical bar member rotatably mounted by at least one right bar mount only to the door adjacent to a right side of the door, the left vertical bar member and the right vertical bar member each having a longitudinal axis;

a plurality of at least three spaced apart left cams each mounted to extend horizontally and perpendicular to the left vertical bar member; and a plurality of at least three spaced apart right cams each mounted to extend horizontally and perpendicular to the right vertical bar member, wherein rotating the left vertical bar member and the right vertical bar member rotates the left cams and the right cams in a horizontal axis from an unlocked position where the door is loosely seated in the tracks and a locked position where the door is pushed against one side of the tracks by the left cams and the right cams, wherein the locked position prevents the water from passing about edges of the door.

* * * * *